US009308148B2

(12) United States Patent
Kane et al.

(10) Patent No.: US 9,308,148 B2
(45) Date of Patent: Apr. 12, 2016

(54) METHODS AND APPARATUS FOR ADJUSTING BLOOD CIRCULATION

(75) Inventors: John Roy Kane, Sierra Vista, AZ (US); Scott A. Christensen, Danville, CA (US); Nathan Hamilton, Incline Village, NV (US); Stephen J. Williams, Danville, CA (US)

(73) Assignee: THERMATX, INC., San Mateo, CA (US)

( * ) Notice: Subject to any disclaimer, the term of this patent is extended or adjusted under 35 U.S.C. 154(b) by 2593 days.

(21) Appl. No.: 11/945,999

(22) Filed: Nov. 27, 2007

(65) Prior Publication Data

US 2008/0132816 A1 Jun. 5, 2008

Related U.S. Application Data

(60) Provisional application No. 60/868,542, filed on Dec. 4, 2006, provisional application No. 60/896,460, filed on Mar. 22, 2007.

(51) Int. Cl.
*A61H 7/00* (2006.01)

(52) U.S. Cl.
CPC ..... *A61H 7/001* (2013.01); *A61H 2201/0103* (2013.01); *A61H 2201/025* (2013.01);
(Continued)

(58) Field of Classification Search
CPC ..... A61H 9/0078; A61H 9/0092; A61H 2209/00; A61H 1/008; A61H 2201/165
USPC ..... 601/1, 15, 16, 40, 148–152, 155, 166; 606/98, 99, 104, 108, 111
See application file for complete search history.

(56) References Cited

U.S. PATENT DOCUMENTS 1,399,095 A 12/1921 Webb, Sr.
3,217,707 A 11/1965 Werding
(Continued)

FOREIGN PATENT DOCUMENTS

EP 1 929 980 4/2007
FR 2544202 10/1984
(Continued)

OTHER PUBLICATIONS

Morris et al., "Evidence-Based Compression: Prevention of Stasis and Deep Vein Thrombosis", Annals of Surgery 239(2), pp. 162-171, Feb. 2004, (C) 2004 Lippincott Williams & Wilkins, Inc.
(Continued)

*Primary Examiner* — Justine Yu
*Assistant Examiner* — LaToya M Louis
(74) *Attorney, Agent, or Firm* — Patterson & Sheridan, LLP; Joseph Stevens

(57) ABSTRACT

A method and device for increasing blood flow by applying positive pressure to extremities of a mammal and/or controlling the temperature of the mammal. The device includes one or more collapsible and pliant body elements capable of expanding and flexibly applying pressurized compression forces to the extremity of the mammal by attaching one or more pressure-applying gas plenums as close to the extremity as possibly. The flexible extremity device can be used independently or can be used in conjunction with thermal pads disposed to the one or more collapsible and pliant body elements. Alternatively, the one or more collapsible and pliant body elements can be manufactured into thermal pads.

1 Claim, 19 Drawing Sheets

(52) U.S. Cl.
CPC . *A61H2201/0207* (2013.01); *A61H 2201/0214* (2013.01); *A61H 2201/0228* (2013.01); *A61H 2201/0242* (2013.01); *A61H 2201/165* (2013.01); *A61H 2201/5071* (2013.01); *A61H 2205/065* (2013.01); *A61H 2205/12* (2013.01); *A61H 2230/50* (2013.01)

(56) References Cited

U.S. PATENT DOCUMENTS 3,507,321 A 4/1970 Palma
3,859,989 A 1/1975 Spielberg
3,878,839 A 4/1975 Norton et al.
3,894,213 A 7/1975 Agarwala
4,149,541 A 4/1979 Gammons et al.
4,186,294 A 1/1980 Bender
4,204,547 A 5/1980 Allocca
4,338,944 A 7/1982 Arkans
4,523,594 A 6/1985 Kuznetz
4,530,350 A 7/1985 Brown et al.
4,624,244 A 11/1986 Taheri
4,648,392 A 3/1987 Cartier et al.
4,658,823 A 4/1987 Beddoe et al.
4,844,072 A 7/1989 French et al.
5,035,003 A 7/1991 Rinehart
5,050,613 A 9/1991 Newman et al.
5,074,285 A 12/1991 Wright
5,149,331 A 9/1992 Ferdman et al.
5,183,039 A 2/1993 Sarian et al.
5,230,333 A 7/1993 Yates et al.
5,241,951 A 9/1993 Mason et al.
5,241,958 A 9/1993 Noeldner
5,314,455 A 5/1994 Johnson, Jr. et al.
5,330,519 A 7/1994 Mason et al.
5,344,436 A 9/1994 Fontenot et al.
5,369,807 A 12/1994 Cho et al.
5,417,720 A 5/1995 Mason
5,437,610 A 8/1995 Cariapa et al.
5,441,477 A 8/1995 Hargest
5,476,490 A 12/1995 Silver
5,507,792 A 4/1996 Mason et al.
5,575,762 A 11/1996 Peeler et al.
5,620,621 A 4/1997 Sontag
5,634,889 A 6/1997 Gardner et al.
5,649,954 A 7/1997 McEwen
5,662,695 A 9/1997 Mason et al.
5,683,428 A 11/1997 Franberg et al.
5,683,438 A 11/1997 Grahn
5,688,225 A 11/1997 Walker
5,729,653 A 3/1998 Magliochetti et al.
5,746,213 A 5/1998 Marks
5,755,756 A 5/1998 Freedman, Jr. et al.
5,865,841 A 2/1999 Kolen et al.
5,868,690 A 2/1999 Eischen, Sr.
5,913,886 A 6/1999 Soloman
5,951,949 A 9/1999 Olsen
5,960,475 A 10/1999 Fewtrell
5,980,561 A 11/1999 Kolen et al.
5,997,816 A 12/1999 McIntosh et al.
6,144,444 A 11/2000 Haworth et al.
6,149,674 A 11/2000 Borders
6,197,045 B1 3/2001 Carson
6,226,552 B1 5/2001 Staunton et al.
6,238,427 B1 5/2001 Matta
6,245,094 B1 6/2001 Pompei
6,268,595 B1 7/2001 Haenel
6,277,143 B1 8/2001 Klatz et al.
6,286,144 B1 9/2001 Henderson et al.
6,296,617 B1 10/2001 Peeler et al.
6,319,214 B1 11/2001 Wortman et al.
6,375,674 B1 4/2002 Carson
6,440,093 B1 8/2002 Nakane et al.
6,446,512 B2 9/2002 Zimmerman et al.
6,461,379 B1 10/2002 Carson et al.
6,488,643 B1 12/2002 Tumey et al.
6,517,510 B1 2/2003 Stewart et al.
6,557,704 B1 5/2003 Randolph
6,565,593 B2 5/2003 Diana
6,576,003 B2 6/2003 Kotack
6,581,400 B2 6/2003 Augustine et al.
6,602,277 B2 8/2003 Grahn et al.
6,620,187 B2 9/2003 Carson et al.
6,645,232 B2 11/2003 Carson
6,648,905 B2 11/2003 Hoglund et al.
6,656,208 B2 12/2003 Grahn et al.
6,660,027 B2 12/2003 Gruszecki et al.
6,666,879 B2 12/2003 Arnold et al.
6,669,715 B2 12/2003 Hoglund et al.
D485,338 S 1/2004 Augustine et al.
6,673,099 B2 1/2004 Grahn et al.
6,679,432 B1 1/2004 Arnold
6,692,518 B2 2/2004 Carson
6,695,872 B2 2/2004 Elkins
6,699,267 B2 3/2004 Voorhees et al.
6,718,785 B2 4/2004 Bieberich
6,763,728 B1 7/2004 Albrecht
6,764,502 B2 7/2004 Bieberich
6,775,473 B2 8/2004 Augustine et al.
6,786,879 B1 9/2004 Bolam et al.
6,802,855 B2 10/2004 Ellingboe et al.
6,827,728 B2 12/2004 Ellingboe et al.
6,830,049 B2 12/2004 Augustine et al.
6,840,915 B2 1/2005 Augustine
6,855,158 B2 2/2005 Stolpmann
6,876,884 B2 4/2005 Hansen et al.
6,921,374 B2 7/2005 Augustine
6,966,922 B2 11/2005 Grahn et al.
6,974,428 B2 12/2005 Knutson et al.
6,974,442 B2 12/2005 Grahn et al.
6,987,209 B2 1/2006 Augustine et al.
6,988,423 B2 1/2006 Bolam et al.
7,001,416 B2 2/2006 Augustine et al.
7,010,221 B2 3/2006 Augustine et al.
7,014,431 B2 3/2006 Hansen et al.
7,041,123 B2 5/2006 Stapf et al.
7,074,982 B2 7/2006 Knutson et al.
7,087,807 B2 8/2006 Stapf
7,090,692 B1 8/2006 Augustine et al.
7,100,394 B2 9/2006 Bieberich et al.
7,101,389 B1 9/2006 Augustine et al.
7,108,713 B1 9/2006 Augustine
7,120,951 B2 10/2006 Augustine et al.
7,122,046 B2 10/2006 Augustine et al.
7,122,047 B2 10/2006 Grahn et al.
7,164,852 B2 1/2007 Cazzini et al.
7,182,776 B2 2/2007 Grahn et al.
7,220,273 B2 5/2007 Van Duren et al.
7,226,454 B2 6/2007 Albrecht et al.
7,232,457 B2 6/2007 Schmidt et al.
7,244,268 B2 7/2007 Arnold et al.
7,264,630 B1 9/2007 Webb
7,351,254 B2 4/2008 Magers
7,361,186 B2 4/2008 Voorhees et al.
7,422,576 B2 9/2008 Boynton et al.
2002/0007201 A1 1/2002 Grahn et al.
2002/0019653 A1 2/2002 Grahn et al.
2002/0022791 A1 2/2002 Morris et al.
2002/0142894 A1 10/2002 Flynn
2003/0024684 A1 2/2003 Lyons et al.
2003/0040783 A1 2/2003 Salmon
2003/0097163 A1 5/2003 Kane et al.
2003/0125649 A1* 7/2003 McIntosh et al. ..... 601/15
2004/0024322 A1 2/2004 Caspers
2004/0073146 A1 4/2004 Weintraub et al.
2004/0077978 A1 4/2004 Nelson et al.
2004/0106884 A1 6/2004 Bolam et al.
2004/0162571 A1 8/2004 Rabiner et al.
2004/0223962 A1 11/2004 Riordan
2005/0027218 A1 2/2005 Filtvedt et al.
2005/0033392 A1 2/2005 Belzidsky
2005/0065583 A1 3/2005 Voorhees et al.
2005/0070954 A1 3/2005 Johnson et al.
2005/0131489 A1 6/2005 Gardon-Mollard
2005/0159690 A1 7/2005 Barak et al.

(56) References Cited

U.S. PATENT DOCUMENTS

| | | | |
|---|---|---|---|
| 2005/0209665 | A1 | 9/2005 | Hunter et al. |
| 2005/0222526 | A1 | 10/2005 | Perry et al. |
| 2005/0251067 | A1 | 11/2005 | Terry |
| 2005/0256556 | A1 * | 11/2005 | Schirrmacher et al. ..... 607/104 |
| 2006/0016012 | A1 | 1/2006 | Liu |
| 2006/0074362 | A1 | 4/2006 | Rousso et al. |
| 2006/0111766 | A1 | 5/2006 | Grahn et al. |
| 2006/0122670 | A1 | 6/2006 | Grahn et al. |
| 2006/0150792 | A1 | 7/2006 | Cazzini et al. |
| 2007/0060987 | A1 | 3/2007 | Grahn et al. |
| 2007/0123962 | A1 | 5/2007 | Grahn et al. |
| 2007/0142887 | A1 | 6/2007 | Cazzini et al. |
| 2008/0021531 | A1 | 1/2008 | Kane et al. |
| 2008/0064992 | A1 | 3/2008 | Stewart et al. |
| 2008/0077205 | A1 | 3/2008 | Cazzini |
| 2008/0208088 | A1 | 8/2008 | Cazzini et al. |
| 2008/0249593 | A1 | 10/2008 | Cazzini et al. |
| 2009/0048649 | A1 | 2/2009 | Peret et al. |
| 2009/0099629 | A1 | 4/2009 | Carson et al. |
| 2009/0112298 | A1 | 4/2009 | Jusiak et al. |
| 2009/0177184 | A1 | 7/2009 | Christensen et al. |
| 2009/0312675 | A1 | 12/2009 | Sampson et al. |

FOREIGN PATENT DOCUMENTS

| | | |
|---|---|---|
| WO | WO 96/28120 | 9/1996 |
| WO | WO 98/40039 | 9/1998 |
| WO | WO 01/80790 | 11/2001 |
| WO | WO 02/085266 | 10/2002 |
| WO | WO 03/045289 | 6/2003 |

OTHER PUBLICATIONS

Frank et al., "Relative Contribution of Core and Cutaneous Temperatures to Thermal Comfort and Autonomic Responses in Humans", Journal of Applied Physiology, vol. 86, Issue 5, pp. 1588-1593, May 1999, http://jap.physiology.org/cgi/content/ful1/86/5/1588#BIBL.

Herrman et al., "Skin Perfusion Responses to Surface Pressure-Induced Ischemia: Implication for the Developing Pressure Ulcer", Journal of Rehabilitation Research & Development, vol. 36 No. 2, Apr. 1999, 20 pages.

De Witte et al, "Perioperative Shivering, Physiology and Pharmacology", Anesthesiology, vol. 96 No. 2, Feb. 2002, pp. 467-484, http://www.or.org/Reviews/four/review.html.

Grahn et al., "Recovery from Mild Hypothermia Can Be Accelerated by Mechanically Distending Blood Vessels in the Hand", J Applied Physiol 85(5): pp. 1643-1648, 1998.

Walsh et al., "Blood Flow, Sympathetic Activity and Pain Relief following Lumbar Sympathetic Blockade or Surgical Sympathectomy", Anesthesia Intensive Care 13(1), pp. 18-24, Feb. 1985.

Kulkarni et al., "Negative Pressure Applied to the Foot Decreases the Body-Core: Great-Toe Temperature Gradient", Abstract, Department of Anesthesia, Stanford University, Stanford, CA, Oct. 13, 2007. http://www.asaabstracts.conn/strands/asaabstracts/abstract.htm;jsessionid=370D6FEE1329050C935DFC3A4EBFB325?year=2007&index=8&absnum=1052.

Sessler, Daniel I., "Complications and Treatment of Mild Hypothermia", Anesthesiology 95(2), pp. 531-543, Aug. 2001.

Grahn et al., "The Physiology of Mammalian Temperature Homeostasis", Department of Biological Sciences, Stanford University, Stanford, CA, http://www.wired.com/wired/archive/15.03/GrahnHeller2004_ITACCS.pdf.

Esburg et al: "Mechanical Characteristics of Human Skin Subject to Static vs Cyclic Normal Pressures". JRRD, vol. 36, No. 2, 1999, http://www.rehab.research.va.gov/jour/99/36/2/edsberg.pdf.

Michael McEwan, "Hypothermia—Physiology, Signs, Symptoms and Treatment Considerations," Search and Rescue Society of British Columbia, www.sarbc.org/hypo1.html, Oct. 28, 1995, pp. 1-6.

Eldar Soreide, et al., "A Non-Invasive Means to Effectively Restore Normothermia in Cold Stressed Individuals: A Preliminary Report," The Journal of Emergence Medicine, 1999, pp. 725-730, vol. 17, No. 4, U.S.A.

Dennis Grahn, "Hypothermia in Trauma-Deliberate or Accidental," Trauma Care '97, 10th Annual Trauma Anesthesia and Critical Care Symposium and World Exposition, May 15-17, 1997, pp. i and 1-21, Baltimore.

International Search Report for EP 07015200 dated Nov. 22, 2007.

Office Action, U.S. Appl. No. 11/566,575 dtd Feb. 18, 2011.

Office Action, U.S. Appl. No. 11/830,486 dtd Mar. 1, 2011.

Radial Artery Access, "For Angioplasty and Stent Procedures". Texas Heart Institute. Oct. 2010.

Layton, et al. "The Radial Artery Access Site for Interventional Neuroradiology Procedures", www.ajnr.org. AJNR Am J. Neuroradiol 27:1151-51. May 2006.

DeviceTalk. Medical Device and Diagnostic Industry. "Wrist and Reward for Stents", Oct. 2010.

European Search Report. EP 08 15 3151 dated Apr. 7, 2011.

International Search Report, PCT/US2011/020601 dated Sep. 23, 2011.

* cited by examiner

METHODS AND APPARATUS FOR ADJUSTING BLOOD CIRCULATION

CROSS-REFERENCE TO RELATED APPLICATIONS

This application claims the benefit of U.S. Provisional Patent Application Ser. No. 60/868,542, filed Dec. 4, 2006, and the benefit of the U.S. Provisional Patent Application Ser. No. 60/896,460, filed Mar. 22, 2007. Each of the aforementioned related patent applications are herein incorporated by reference.

BACKGROUND OF THE INVENTION

1. Field of the Invention

Embodiments of the invention generally relate to methods and apparatus for increasing blood flow within a human extremity and/or adjusting and maintaining the temperature of the body core.

2. Description of the Related Art

Homoiothermic animals, such as humans, strive to maintain relatively constant internal temperatures despite temperature variations in ambient environments and fluctuations in internal heat released as cellular metabolism byproducts. In humans, the thermal core generally includes the vital organs of the body, such as the brain and the several organs maintained within the abdomen and chest. Peripheral tissues, such as the skin, fat, and muscles, act as a buffer between the thermal core and the external environment of the animal by maintaining a temperature gradient that ranges from near-core temperature within internal organs to near-ambient temperature at the surface of the animal.

Mammalian temperature regulation requires adaptation mechanisms, such as insulation, respiratory heat conservation, and passive heat dissipation, etc., to enable mammalian survival without excessive resource expenditure to generate a stable internal thermal environment. Insulation, internal or external, impedes heat transfer from ambient condition to the body core and also protects animals from the cold. Subcutaneous insulation, similarly, retards the transfer of heat from the skin surface into the body core. The insulative properties of peripheral tissues are determined by blood flow through the tissues and in the absence of blood flow, heat transfer through the tissues is negligible. For example, lack of blood flow and poor blood perfusion makes adipose tissues good insulators. Any tissues that are poorly perfused may become insulators. Tissue blood perfusion determines local heat transfer and enables delivery of heat to (or removal from) a body region.

Respiratory heat conservation is an adaptive mechanism to prevent heat loss, heat exchange between the circulating blood and the air at the gas exchange surface of the lung alveoli in mammals. All of the circulating blood passes through the gas exchange surfaces of the lungs.

Heat is dissipated to the environment from the thermal core to the body surface via blood flow within the confines of the circulatory system. The distribution of the systemic blood is in accordance with local tissue metabolic demand. All blood passes through the chambers of the heart and the lungs. Cardiac output in a resting human is about 5 L/min so that the total blood volume circulates at a turnover rate of one cycle per minute. Blood volume and cardiac output in mammals are insufficient to uniformly perfuse all tissues in the body. Specialized vascular structures promote heat exchange in the blood flow.

Two types of vascular structures are found in mammals: nutrient vascular units and heat exchange vascular units.

Their functions are mutually exclusive: The nutrient vascular units contain thin-walled, small diameter blood vessels uniformly distributed throughout the skin, such as arterioles, capillaries, and venules, and require slow blood flow through to provide nutrients to local tissues. The heat exchange vascular units contain thick-walled, large diameter venules, such as venous plexuses and Arteriovenous Anastomoses (AVAs; vascular communications between small arteries and the venous plexuses), and require flowing of large blood volumes to promote heat dissipation. In humans, the venous plexuses and AVAs of the heat exchange vascular units in humans are found mainly in the non-insulated palms of the hands, soles of the feet, ears, and non hairy regions of the face.

The thermoregulatory system in homoiothermic animals can be compromised by many factors (anesthesia, trauma, environment, others) and may lead to the various thermal maladies and disease conditions. Upon induction of general anesthesia, for instance, induced hypothermia may occur due to temperature redistribution from the core to the periphery cause by systemic vasodilation caused by the anesthetic agents. Thermal maladies, such as hypothermia and hyperthermia, can occur when the thermoregulatory system is overwhelmed by severe environmental conditions. Constriction of the AVAs thermally isolates the body core from the environment, while, dilation of the AVAs promotes a free exchange of heat between the body core and the environment.

Blood flow through the heat exchange vascular structures can be extremely variable, for example, high volume of blood flow during heat stress or hyperthermia can be increased to as high as 60% of the total cardiac output. Hypothermia, on the other hand, is the result of prolonged exposure to a cold challenge where blood flow through the venous plexuses and AVAs can be near zero of the total cardiac output. Vasoconstriction of the peripheral blood vessels may arise under hypothermia in order to prevent further heat loss by limiting blood flow to the extremities and reducing heat transfer away from the thermal core of the body. However, vasoconstriction makes it much more difficult to reverse a hypothermic state since vasoconstriction impedes the transfer of heat from the body surface to the thermal core and makes it difficult to simply apply heat to the surface of the body. This physiological impediment to heat transfer is referred to as a vasoconstrictive blockade to heat exchange. There is a need to regulate blood flow to the venous plexuses and AVAs of the heat exchange vascular units in order to intervene and correct thermal maladies.

Other thermal malady related diseases, such as venous thromboembolic disease, continues to cause significant morbidity and mortality. Hospitalization due to venous thrombosis and pulmonary embolism (PE) ranges from 300,000 to 600,000 persons a year. Following various types of surgical procedures, as well as trauma and neurological disorders, many patients are at risk for developing deep vein thrombosis (DVT) which can manifest into pulmonary embolism (PE). PE usually originate from blood clots in the deep veins of the legs where pieces of thrombus (clots) may break off and travel to the lung. Regardless of the original reasons for hospitalization, one in a hundred patients upon admission to hospitals nationwide dies of PE. Patients suffering from hip, tibia and knee fractures undergoing orthopedic surgery, spinal cord injury, GI, or GU surgical procedures are especially at high risk for developing DVT. Thus, prevention of DVT is clinically important.

It is believed that slowing of the blood flow or blood return system from the legs may be a primary factor related to DVT formation with the greatest effect during the intraoperative phase due to lack of movement (anesthetic paralysis) and enzyme release instigated by the act of surgical incisions. Also of concern is the postoperative period. Generally, without mobility, return of the blood back to heart is slowed and the veins of an individual rely only on vasomotor tone and/or limited contraction of soft muscles to pump blood back to the heart. One study shows that airline travel as short as three to four hours can induce DVT.

Current approaches to medical prophylaxis include anticoagulation therapy and/or mechanical compression to apply pressure on the muscles through pneumatic compression devices. Anticoagulation therapy requires blood thinning drugs to both thin the blood and clear clots in the veins which must be taken several days in advance to be effective. In addition, these drugs carry the risk of bleeding complications, thus cannot be used for prophylaxis for surgical induced DVT. Sequential pneumatic compression devices (SCD), which mechanically compress and directly apply positive message-type pressures to muscles in the calf and foot sequentially, are routinely used in the hospital setting but are cumbersome and difficult to use.

U.S. Pat. No. 5,683,438, issued to Grahn and assigned to Stanford University, discloses an apparatus and method for overcoming the vasoconstrictive blockade to heat exchange by mechanically distending blood vessels in a body portion and providing heat transfer to the body core of a hypothermic mammal. The disclosed device comprises a fluid-filled heating pad that is lodged within a tubular, elongated hard shelled sleeve placed over the body portion. Sub-atmospheric pressure is applied and maintained within the sleeve. However, most devices for regulating body temperature may not provide sufficient heat or adequate surface area for heat transfer optimization or the ability to evenly distribute the heat via the heating element and the body surface of the patient. In addition, the devices may not be able to adapt to the variability in patient sizes or provide mobility of the body portion during prolong treatment.

Therefore, there remains a need for an apparatus and method to increase blood flow to and through the venous plexuses and AVAs of the heat exchange vascular units, thereby reducing the vasoconstrictive blockade and promoting both heat exchange for body temperature regulation and/or prevention of blood pooling, DVT formation, and potential death caused from PE.

SUMMARY OF THE INVENTION

Embodiments of the invention provide methods and apparatus for increasing blood flow and/or controlling body temperature which can be used in regulating body temperature to prevent and/or intervene thermal maladies, deep vein thrombosis, PE and other disease arising from a compromised thermal regulatory system inside a mammal. In one embodiment, a flexible extremity device is provided for regulating temperature and providing positive pressure or compression on an extremity of a mammal, such as a hand, an arm, a leg, foot, or calf of a leg, in order to increase blood flow in the extremity.

According to an embodiment of the invention, the flexible extremity device is provided to flexibly apply pressurized compression forces to an extremity of a mammal by attaching one or more pressure-applying gas plenums as close to the extremity as possibly. The flexible extremity device can be used independently or can be used in conjunction with thermal pads disposed to the body of the flexible extremity device.

The present invention generally provides a device for increasing blood flow and controlling body temperature, comprising a plenum having one or more walls that enclose an internal region, wherein at least one of the one or more walls is adapted to be disposed over a region of a patient, one or more thermal exchanging units that are disposed between the one or more walls and the region of the patient, and a pump that is adapted to control the pressure within the internal region to urge the one or more thermal exchanging units against the region of the patient to improve the thermal contact between the one or more thermal exchange units and the region of the patient.

Embodiments of the invention further provide a device for increasing blood flow and controlling body temperature in a mammal, comprising a plenum having one or more walls that enclose an internal region, wherein at least one of the one or more walls is adapted to be disposed over a region of a patient, one or more thermal exchanging units that are disposed between the one or more walls and the region of the patient, and a manifold having a first fittings that is in fluid communication with the internal region of the plenum and a second fitting that is in fluid communication with a fluid plenum formed in one of the one or more thermal exchanging units, and a controller system comprising a first pump that is adapted to control the pressure within the internal region when it is in fluid communication with the first fitting, a fluid heat exchanger having a thermal exchanging fluid that is adapted to control the temperature of the one or more thermal exchanging units when it is in fluid communication with the one or more thermal exchanging units, a pressure sensor that is in fluid communication with the internal region of the plenum, a temperature sensor that is adapted to measure a temperature of the mammal, and a controller that is adapted to control the temperature of the fluid heat exchanging fluid and the pressure of the internal region of the plenum using inputs received from the temperature sensor and the pressure sensor, and control the first pump.

Embodiments of the invention further provide a method of increasing blood flow and controlling body temperature in a mammal, comprising disposing a plenum assembly over a portion of an extremity of a mammal, wherein the plenum assembly comprises one or more walls that enclose an internal region, disposing one or more thermal exchanging units on a surface of the portion of the extremity, controlling the temperature of the one or more thermal exchange units, and adjusting the pressure in the internal region to cause at least one of the one or more walls to urge at least one of the one or more thermal exchange units against the surface of the extremity.

In another embodiment, a device for increasing blood flow and controlling body temperature includes one or more collapsible and pliant body elements with one or more pressure-applying gas plenums and one or more pressure ports attached thereto. The one or more collapsible and pliant body elements are capable of applying positive pressure or compression onto an extremity of a mammal. A sealing element is also provided to seal the one or more collapsible and pliant body elements when a portion of the extremity is enclosed inside the one or more collapsible and pliant body elements.

In a further embodiment, a device for increasing blood flow and controlling body temperature includes a first body element and a second body element, capable of folding into a space by enclosing the first body element and the second body element together. The device also includes an opening formed from the ends of the first body element and the second body element when the first body element and the second body element are folded and enclosed into the space for a portion of an extremity of a mammal to be inserted therein; wherein the space formed by the first body element and the second body element is capable of expanding from a minimized first volume into an expanded second volume for containing a portion of the extremity therein. The device further includes one or more pressure-applying gas plenums and one or more pressure ports attached to the first body element and the second body element. The first body element and the second body element are made of collapsible and pliant materials and are capable of applying positive pressure or compression onto an extremity of a mammal. A sealing element is also provided to seal the first body element and the second body element when a portion of the extremity is enclosed inside the first body element and the second body element.

In still another embodiment, a device for increasing blood flow and controlling body temperature includes a thermal exchange unit having a body portion enclosing one or more fluid channels therein and adapted to contact a portion of an extremity of a mammal, wherein the body portion of the one or more thermal exchange units is comprised of a collapsible and pliant material. The device also includes one or more pressure-applying gas plenums and one or more pressure ports attached thereto. The one or more collapsible and pliant body elements are capable of applying positive pressure or compression onto an extremity of a mammal. A sealing element is also provided to seal the one or more collapsible and pliant body elements when a portion of the extremity is enclosed inside the one or more collapsible and pliant body elements.

Still, a method is provided and includes providing to one or more extremities of the mammal one or more devices having one or more collapsible and pliant body elements as described herein, sealing the portion of the one or more extremities around an opening of the devices using a sealing element attached to the opening, applying positive pressure to one or more pressure-applying gas plenums and one or more pressure ports attached to the one or more collapsible and pliant body elements. The one or more collapsible and pliant body elements are capable of applying positive pressure or compression onto an extremity of a mammal, and increasing blood flow of the one or more extremities using the one or more devices. The one or more devices may include one or more thermal exchange units having a fluid medium flown therein for adjusting the temperature of the mammal. In addition, the one or more devices may include electric thermal exchange units.

Further, a method is provided for increasing blood flow and controlling the temperature of a mammal. According to one or more embodiment of the invention, the method includes providing to one or more extremities of the mammal one or more devices, sealing the portion of the one or more extremities around an opening of the one or more devices using a sealing element formed on a portion of the opening. The one or more devices includes one or more thermal exchange units adapted to contact the portion of the one or more extremities, and one or more collapsible and pliant body elements having one or more pressure-applying gas plenums and one or more pressure ports attached thereto. The one or more collapsible and pliant body elements are capable of applying positive pressure or compression onto an extremity of a mammal. The method further includes adjusting the positive pressure inside the one or more pressure-applying gas plenums and increasing blood flow of the one or more extremities using the one or more devices.

In a further embodiment, a method of increasing blood flow includes regulating the temperature of one or more extremities of a mammal and exposing the one or more extremities to a positive pressure or compression provided from one or more pressure-applying gas plenums attached to one or more collapsible and pliant body elements of a flexible extremity device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
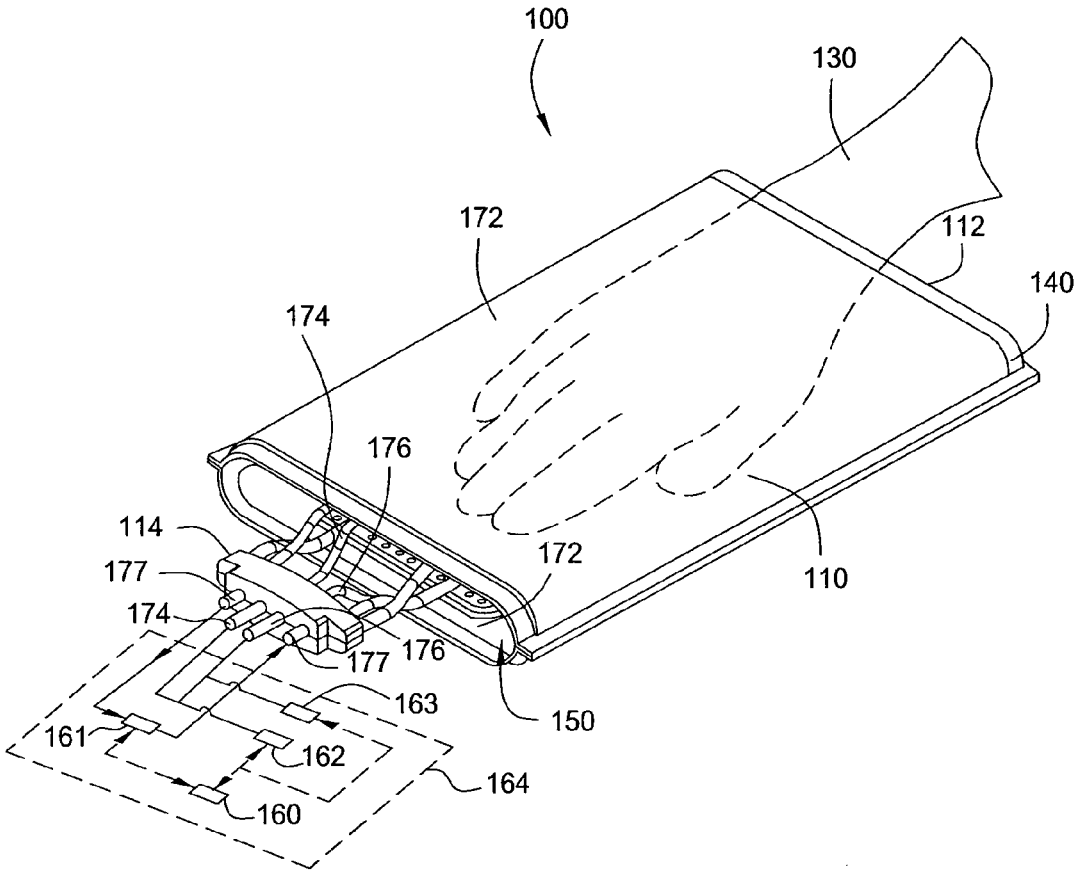
FIG. 1 illustrates an exemplary device according to one embodiment of the invention.

Embodiments of the invention include a method and a device for increasing blood flow of a mammal by applying positive pressure to extremities of a mammal. The device generally includes one or more collapsible and pliant body elements, capable of applying compression forces to an extremity of the mammal. In one embodiment, one or more thermal exchange units are attached to the one or more collapsible and pliant body elements, and thus are configured to contact a portion of the extremity so that the temperature of the extremity can be controlled. Accordingly, the temperature of the extremity of a mammal can be regulated by providing a heated or cooled fluid medium or electric thermal energy to the one or more thermal exchange units. By pressurizing the one or more collapsible and pliant body elements the contact surface area between the extremity of a mammal and the one or more thermal exchange units can be increased, due to the applied pressure acting on the one or more thermal exchange units against the skin of the extremity of the mammal. The application of pressure assures that sufficient contact and thermal heat transfer (heating or cooling) is provided to the extremity of the mammal. By controlling the application of pressure to the mammal's extremity that is positioned between the one or more collapsible and pliant body elements skin perfusion can be improved. The pressure that is applied to the region surrounding the extremity can be adjusted to increase the blood perfusion at the skin surface of the extremity, and also improve heat transfer to the blood and rest of the body. It is believed that regulating the pressure applied to the mammal's extremity about 13.5 mmHg will provide a desirable increase of blood perfusion. It should be noted that increasing the applied pressure to greater than about 40-80 mmHg can reduce the blood flow in the extremity.

The extremity can be any kind of the extremity of a mammal, such as an arm, a hand, a forearm, a forearm with an elbow, a hand with a wrist, a limb, a foot, a leg, a calf, an ankle, toes, etc., where Arteriovenous Anastomoses (AVAs) are located and/or when increased blood flow is desired. Arteriovenous Anastomoses (AVAs), which are connected to arteries and veins, are specialized blood vessels located primarily in the palms and fingers of the hands, the soles and toes of the feet, the cheeks, and the ears, etc. It is recognized that the device described herein may be adapted for use with other extremities that have vasculature structures suitable for the increasing blood flow methods described herein. Regulating the temperature of the mammal's extremity may include elevating, cooling, and/or maintaining the mammal's temperature. The mammal may be a human or other mammal. People at high risk of DVT, PE and other conditions, such as edema, wound swelling, venous stasis ulcers, diabetic wounds, decubitous ulcer, orthopedic surgery patients, spinal cord injured individuals, among others, can benefit from the invention.

According to one or more embodiments of the invention, devices and methods are provided to intervene thermal maladies (e.g., hypothermia and hyperthermia, etc.), to regulate the temperature of the extremity of a mammal when the thermoregulatory system of the mammal is compromised (e.g., by general anesthesia, local anesthesia, trauma, post-surgery conditions, or other factors), and/or to prevent deep vein thrombosis (DVT), pulmonary embolism (PE), and other diseases. The devices and methods as described herein are tested to be able to increase blood flow in the extremity of the mammal, which may include an appendage. Experiments performed on humans that have diabetes indicate that optimal pressure to increase blood flow could be about 13-14 mmHg, but that pressures between 0 and 100 mmHg, and more preferably 3 and 40 mmHg and more preferably 5 and 20 mmHg can increase blood perfusion. Pressures of approximately 14 mmHg combined with appropriate heat can increase blood flow, as a percent per minute of the volume of the appendage (in this case an arm) from a base level of between about 4% per minute to an increased level of about 8% per minute. The pressure applied to the skin by the device can be used to increase blood flow, which can be accomplished by a variety of methods including, but not limited to pressurizing, or inflating, a cuff that encompasses a significant portion of appendage. Some results are discussed below.

In one embodiment, an device for increasing blood and preventing deep vein thrombosis (DVT) is provided to a mammal's extremity by applying pressure to the one or more pressure-applying gas plenums attached to a compliant and flexible body element of the device, thereby increasing blood flow, promoting venous blood return, and reducing blood clots inside the mammal's extremity. Not wishing to be bound by theory, it is believed that, by applying a positive pressure to the body elements of the device the compression forces applied to the skin of the mammal's extremity will increase blood flow. In addition, when one or more thermal exchange units are used in conjunction to applying the compression forces, the surface area of the contact between the mammal's extremity and the one or more thermal exchange units are increased, thereby regulating the temperature of the mammal's extremity to provide as much thermal exchange as possible and increase the blood flow of the mammal's extremity and/or increase venous return. In particular, the invention provides a non-invasive, convenient apparatus for efficiently adjusting the temperature and/or applying compression forces to the mammal's extremity to increase blood flow, promote venous blood return, prevent clots in the veins, and prevent DV, among others. In one embodiment, a device is used to regulate the core temperature of a mammal's body by exchanging heat between a portion of a single extremity of the mammal and one or more thermal exchanging elements contained within the device.

Figure 2A:
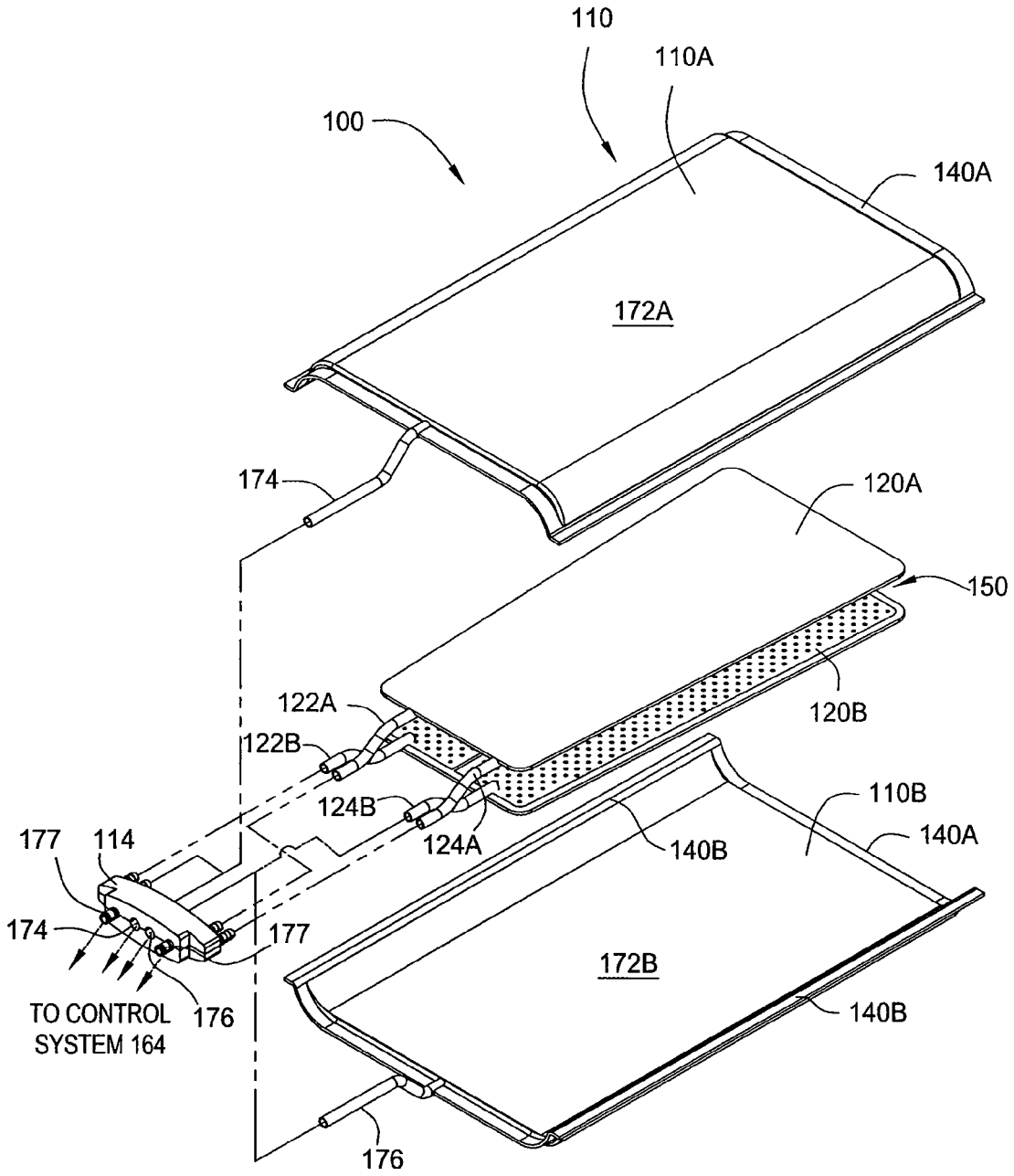
FIG. 2A is a perspective view of an exemplary device according to one embodiment of the invention.

FIG. 1 is an isometric view of one embodiment of a device 100 that is used to increasing blood flow by transferring heat to a mammal's extremity. FIG. 2A is an exploded isometric view of one embodiment of device 100. The device 100 is used to transfer heat to and/or from a mammal's extremity, such as an arm, a hand, a forearm, a forearm with an elbow, a hand with a wrist, a limb, a foot, a leg, a calf, an ankle, toes, etc., where AVAs are located to provide an improved and efficient control of the patients temperature, and blood flow in the extremity. In one embodiment, device 100 contains one or more collapsible and pliant body elements, or hereafter body elements 110, that form a space 150 into which an extremity 130 of a mammal can be inserted. The device 100 includes an opening 112 formed between portions of the one or more body elements 110 so that an extremity disposed therein can receive compression forces and/or be heated or cooled by use of one or more gas plenums 172A, 172B and/or one or more thermal exchange units 120A, 120B. Optionally, a sealing element 140 is attached to the opening 112 for securing the extremity 130 enclosed inside the device.

The body element 110 is generally designed so that it will occupy a minimum amount of space, or volume, so that it can be easily and conveniently folded, stored, or shipped. The material of the body element 110 is made of a flexible material, which can be pliant and easily collapsible to conform into the shape of the extremity and securely surround and enclose the portion of the extremity to the device 100. Thus, good contact is provided between the surfaces of the extremity 130 and the body element 110. The body element 110 is generally capable of being expanded from a minimized volume into an expanded volume for containing a portion of an extremity of a mammal therein. It is generally desirable to use a body element 110 that is flexible enough to allow the pressure applied to each and every portion of the extremity 130 enclosed inside the device 100 to be evenly and equally distributed. In general, the body element 110 comprises one or more gas plenums 172 that apply pressure to the mammal's extremity disposed there-between. The gas plenums 172 of the body element 110 are connected to one or more fluid lines that supply gases (e.g., air) and/or liquids to and from the gas plenums 172 in the body element 110. In one embodiment, as illustrated in FIG. 1, the fluid supply lines are connected to the connected to the fluid supply ports 174, 176 contained in a manifold 114.

The body element 110 is comprised of a collapsible and pliant material, including but not limited to, urethane, polyurethane, polypropylenes, polystyrenes, high density polyethylene's (HDPE), low density polyethylene's (LDPE), poly (vinyl chloride), rubbers, elastomers, polymeric materials, composite materials, among others. For example, the body element 110 can be made of disposable low cost materials. The collapsible and pliant material may comprise any suitable flexible material, for example, gas permeable thermoplastics, elastomeric materials, such as C-FLEX™ from Consolidated Polymer Technologies, Inc. (Largo, Fla.), DynaFlex from GLS Corporation (McHenry, Ill.), materials available from Argotec (Greenfield, Mass.), and other elastomeric materials with similar properties. In one embodiment, the collapsible and pliant material comprises a material that is temperature resistant. The body element 110 can also be made of a biocompatible or hypo-allergenic material (and therefore safe for contact with the skin of a mammal), alternatively, the body element can be made of a transparent or semi-transparent material that allows viewing of the extremity 130 positioned therein. As another example, the body element 110 may be made of materials that may be sterilized via autoclaving or ethylene oxide sterilization. This is especially important if the device 100 is used during surgery where sterile conditions are very important. The thickness of the collapsible and pliant material is not limited as long as it can sustain the pressurized conditions when the device 100 is used. In one example, a urethane material having a thickness from about 1.5 mils to about 12 mils can be used to compliantly conform to the shape and size of the portion of the extremity 130 contained therein. In general, the thickness of the collapsible and pliant material is not limited as long as it is compliant enough to substantially conform to the extremity and can sustain the desired pressurized conditions when the device 100 is in use.

Embodiments of the invention provide subjecting portions of an extremity of a mammal to a pressurized condition by supplying gases and/or liquids to the gas plenum 172 of the body element 110, thereby supplying pressure to the extremity disposed in the space 150 so that the blood flow in the extremity 130 can be increased. The pressure inside the one or more gas plenums 172 of the body element 110 can be regulated to a pressure level of between about 5 mmHg to about 20 mmHg, thereby allowing pressure to be supplied to portions of the extremity to increase blood perfusion.

Optionally, one or more thermal exchange units 120A, 120B are attached to one or more portions of the body element 110 and adapted to contact the portion of the extremity 130 under pressurized conditions to increase, reduce, or maintain the temperature of the extremity 130 received therein. The thermal exchange unit 120A, 120B can be permanently or detachably placed inside the device 100 to provide thermal exchange for the extremity 130 received therein. Examples of some exemplary thermal exchange units 120A, 120B are illustrated and further discussed in conjunction with FIGS. 3A and 3B.

A thermal-exchange fluid medium, such as heated fluid, heated air, cooled fluid, or cooled air, etc., can be provided from a fluid source 161 into the thermal exchange units 120A, 120B via one or more fluid supply lines 124A, 124B and out of the device 100 via one or more fluid return lines 122A, 122B. The temperature of the one or more thermal exchange units positioned in the device 100 may also be controlled by use of an electric pad, fluid type heat exchanging device, or any other suitable thermal exchange units, that are used individually or in combination. Thermal energy can be transferred from the thermal exchange unit to the extremity 130 during heating or from the extremity 130 to the one or more thermal exchange units during the process of cooling the extremity 130. For example, the thermal exchange units 120A, 120B may be a fluid heating pad having, for example, heated water delivered there through using a recirculation type heat exchanging system. As another example, the thermal exchange units 120A, 120B may be a pad having chemicals therein that are used to heat or cool the extremity. Alternatively, the thermal exchange units 120A, 120B may include an electric pad, as described in detail in co-pending U.S. provisional patent application Ser. No. 60/821,201, filed Aug. 2, 2006, which is incorporated by reference herein. It is generally desirable to assure that equal and even contact is created between the extremity of the patient and a thermal exchange unit to maximize thermal contact and improve the exchange of heat between the extremity and the thermal exchange unit.

When in use, good contact between with the thermal exchange units 120A, 120B and the extremity 130 are important for maximizing the heat transfer between the extremity 130 and the thermal exchange units 120A, 120B. By supplying a fluid to the one or more gas plenums 172 in the body element 110, compression forces are exerted onto the thermal exchange units 120A, 120 and also onto the extremity, thereby increasing the contact surface area between the thermal exchange units 120A, 120B and the extremity 130. As such, thermal energy can be efficiently and evenly distributed across the surface of the extremity 130. Accordingly, the materials of the body element 110 and the thermal exchange units 120A, 120B are made of flexible materials that can conform to the shape of the extremity and securely surrounds a portion of the extremity to provide good thermal and/or physical contact. To control the pressure supplied to the one or more gas plenums 172 in the body element 110 a pressure sensing device (i.e., pressure sensor 162) can be connected to the one or more fluid supply ports 174, 176.

Figure 7:
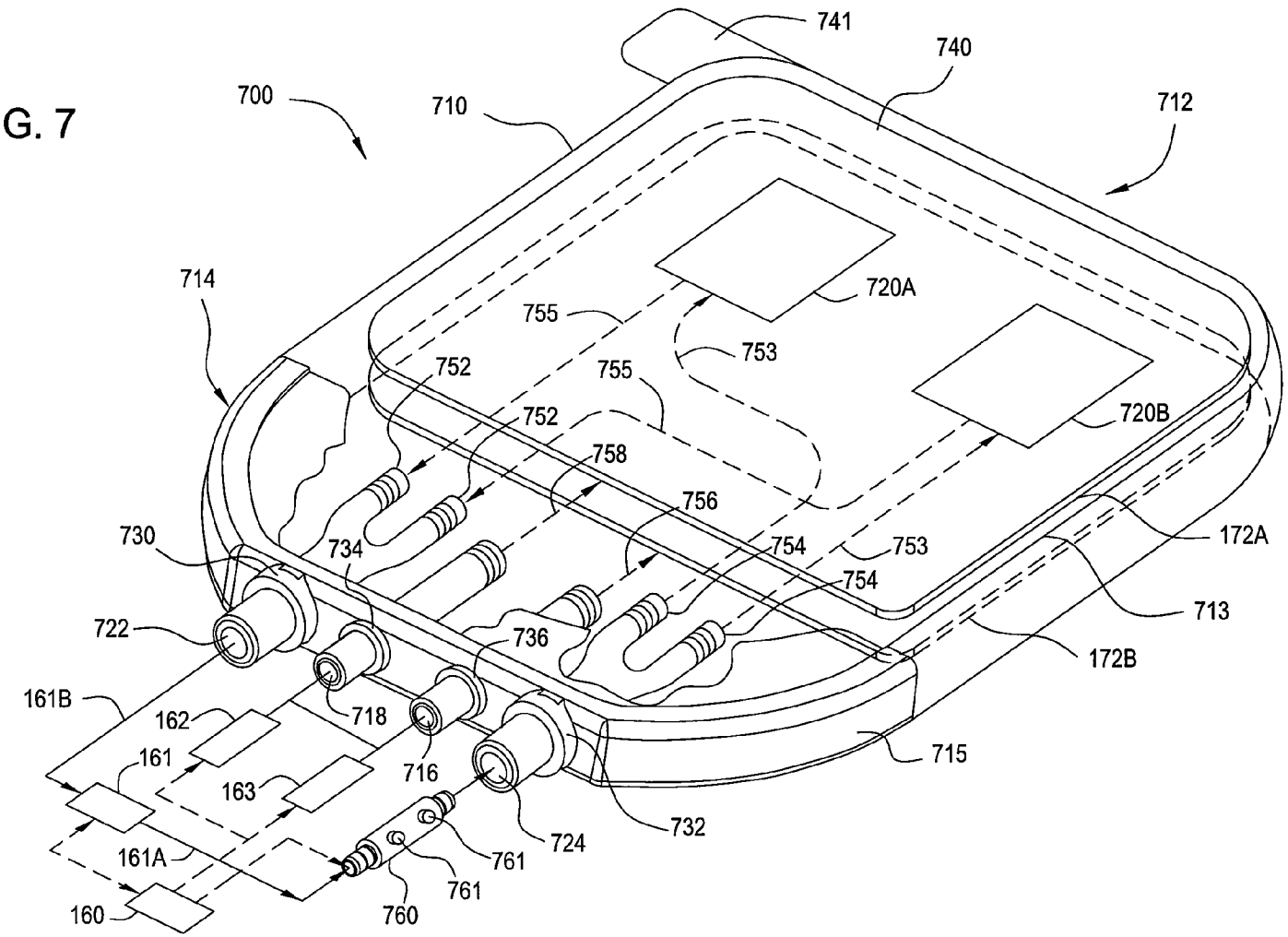
FIG. 7 illustrates an exemplary manifold with one or more fittings to be connected to various gas, vacuum or fluid lines according to an embodiment of the invention.

In one embodiment, a manifold 114 may be formed or disposed on a portion of the body element 110 to provide the connections between the various external components to the device 100. The fluid supply ports 174, 176, the fluid supply line ports 177, fluid supply line 124A, 124B and/or the fluid return lines 122A, 122B may be covered by protective sheaths. The manifold 114 generally contains fluid supply line ports 177 and one or more fluid supply ports 174, 176 that are connected to various kinds of tubing and/or connectors to connect the various external components in the device 100 to the various components in the device 100. An embodiment of the manifold 114 is shown in FIG. 7 to incorporate quick connecting and disconnecting fittings. The position of the manifold 114 can be located near any convenient portions of the body element 110 by grouping gas supply lines and fluid lines together.

The sealing element 140 is formed on a portion of the opening 112 and adapted to form a seal between the body element 110 and a portion of the extremity 130. The sealing element 140 is generally sized and used to seal the opening according to the size of the portion of the extremity 130. The sealing element 140 may be made of a material that is biocompatible (and therefore safe for contact with the skin of a mammal) and capable of producing an airtight seal. In one embodiment, the sealing element 140 is detachably attached to the opening 112. In another embodiment, the sealing element 140 is comprised of a disposable material, such as a disposable liner or an insert material. For example, the material of the sealing element 140 may be hydrogel, a sticky seal material, polyurethane, urethane, among others. One example of the material is hydrogel. Another example is a PS series thermoplastic polyurethane from Deerfield Urethane, Inc. Disposable sealing materials may be manufactured and packaged such that they are sterile before use and/or hypoallergenic to meet the various health and safety requirements. The sealing element 140 may include an air permeable portion and/or made of a permeable membrane material to permit an exchange of air across the sealing element 140. Examples of breathable materials are available from Securon Manufacturing Ltd. or 3M Company.

In one embodiment, the sealing element 140 can be wrapped around a portion of the extremity of the mammal to seal the opening 112. Example of the sealing element 140 includes mechanical fasteners or other fastening units (e.g., Velcro fasteners). One example includes one or more conventional mating rings which can snap into the device 100. Another example includes the use of a tape with a removable liner, such as 3M removable tapes, etc., which can be removed when ready to use. In one embodiment, the sealing element 140 is a single use seal. In another embodiment, the single use sealing element 140 is attached to the device 100, and the device and the sealing element 140 are disposed of after a single use. In still another embodiment, the sealing element 140 may be removed from the device 100 and the device may be used repeatedly with another sealing element.

In one embodiment, the sealing element 140 may comprise a strip of releasable adhesive tape ranging from 0.5 inches to 6 inches in width, e.g., a width large enough to cover the bottom of the extremity 130. The sealing element 140 may comprise an adhesive face and a backing portion. The sealing element 140 is generally long enough that when wrapped end over end around the edge of the opening 112, an overlap of about 0.5 inches or larger, such as about 2 inches, is present. The overlap is preferably not to encourage the user to wrap the sealing element 140 around the extremity too tightly and thus create a modest sealing force, e.g., less than 20 mm Hg. The material of the sealing element 140 may comprise a releasable adhesive material for attachment to a mammal extremity in some portion and a more permanent adhesive in other portions thereof for attaching the sealing element 140 to the device 100. The releasable adhesive material may be any of a wide variety of commercially available materials with high initial adhesion and a low adhesive removal force so that the sealing element 140 does not pull off hair or skin and create pain when it is removed. For example, the releasable adhesive may be a single use adhesive. In addition, the adhesive material may be thick and malleable so that it can deform or give, in order to fill gaps. Adhesives with water suspended in a polymer gel, e.g., a hydrogel, are generally effective. One example of such an adhesive is Tagaderm branded 3M adhesive (part No. 9841) which is a thin (5 mm) breathable adhesive that is typically used for covering burns and wounds. Another example is an electrocardiogram (EKG) adhesive such as 3M part No. MSX 5764, which is a thicker adhesive (25 mm). The sealing element 140 should fasten such that there is no leakage of the vacuum.

In one embodiment, the sealing element 140 has a backing that may be a thin, non-elastic, flexible material. The backing supports the adhesive and keeps it from being pulled away from the opening 112 when the gas plenums are pressurized. The backing also allows the adhesive to conform to both the shape of the extremity 130 and the shape of the opening 112. Furthermore, the backing prevents the adhesive from sticking to other surfaces. Commercially available polyethylene in thicknesses up to about 10 millimeters may be used for the backing. Polyethylene that is thicker than about 10 millimeters may limit the adhesive's ability to fold on itself and fill in gaps. The backing may also comprise any polymer that may be fabricated into a thin, non-elastic, flexible material. In one embodiment, the sealing element 140 comprises a backing has an adhesive disposed on two opposing adhesive faces to allow it to be attached to the body element 110 and the extremity 130. For example, 3M EKG adhesive products MSX 5764 contains a supportive backing in between multiple layers of adhesive. Multiple layers of backing can also be used to provide support for the sealing element 140.

The opening 112 of the device is preferably close to the size of the patient's extremity to minimize the difference in dimensions that the sealing element 140 must cover. The smallest opening size that will accommodate the range of extremity dimensions, such as foot sizes is preferred. The sealing element 140 is typically able to be formed of different sizes to accommodate extremity sizes down to the size of a small adult and up to various sizes of a large adult. For example, multiple opening sizes, such as small, medium, and large may be used to accommodate a wider range of foot sizes.

Alternatively, the opening 112 may be adapted to contract within a size range of the extremity 130 without constricting blood flow to further minimize this force and make the sealing process by the sealing element 140 easier. For example, one or more strings may be used to tighten the opening 112 to the extremity 130. In another embodiment, external buckles, Velcro fasteners, and straps, among others, may also be used to surround the opening 112 of the device 100 and secure the opening 112 around the extremity 130.

In addition, one or more portions of the body element 110 may be made from transparent materials such that the functioning of the device and the condition of the extremity may be monitored during use of the device. In an alternative embodiment, the body element 110 may be divided into two or more body sections to be assembled into the device 100 and secured by one or more fastening units, such as Velco fasteners, or snaps (e.g., device 900 in FIG. 9).

The device 100 may further include a control system 164 that contains a controller 160 that is connected to various parts of the device 100, including the pump 163 and pressure sensor 162 connected to one or more of the pressure ports, the fluid source 161 connected to one or more of the fluid lines (e.g., fluid supply line 124A, 124B, fluid return lines 122A, 122B) that are connected to the one or more thermal exchange units 120A, 120B. In one embodiment, the pump 163 is mechanical pump or a gas source (e.g., gas cylinder) that is adapted to pressurize and depressurize the gas plenums 172. The controller 160 may be adapted to regulate the functions and process performed by the device 100, including adjusting the fluid flow in and out of the thermal exchange units 120A, 120B, regulating the temperature of the thermal exchange units 120A, 120B, monitoring the pressure level inside the one or more gas plenums 172 via one or more pressure sensors 162, and monitoring the temperature of the extremity 130 received therein, among others.

In one embodiment, the devices described herein may include an in-use sensor indicating that the device is in use by use of the pressure sensors 162 or a pressure switch (not shown) that are connected to the one or more gas plenums 172. In addition, the in-use sensor and/or controller 160 may indicate how many times the devices have been used.

In one embodiment, the control system 164 is used to increase control the temperature of a patient. Accordingly, in operation, the pump 163 in conjunction with the control controller 160 and pressure sensor 162 are adapted to deliver a fluid to the one or more gas plenums 172 so that a pressure can be applied and regulated in a range between about 3 mmHg and about 20 mmHg to increase the blood perfusion in the extremity. For example, the pressure can be adjusted to a positive pressure level, such as to about 10 mmHg plus or minus 2 mmHg. In one embodiment, it is desirable to use the controller 160 to control the temperature of the thermal exchange units 120A, 120B using the fluid source 161 and control the pressure within the one or more gas plenums 172 using the pump 163 and pressure sensor 162 to actively control the temperature and force applied to the extremity 130 to increase the blood perfusion and temperature control of the patient. In another embodiment, the control system 164 can be used to sequentially apply compression forces to the extremity 130 to help pump blood through the patient's body.

FIG. 2A is an exploded view of the device 100, shown in FIG. 1, having a body element 110 that is shown segmented into an upper body element 110A and a lower body element 110B which are both made of a collapsible and pliant material. As shown, the body elements 110A, 110B may each contain a gas plenum 172A, 172B, respectively. The fluid supply ports 174, 176 are adapted to connect to the gas plenums 172A, 172B for supplying air, gases, or others into the body elements 110A, 110B by use of pump 163 (FIG. 1). In one embodiment, the body elements 110A, 110B are separately formed elements that are bonded together at a sealing region 140B to form the space 150 in which the extremity is disposed during normal operation. The bond formed at sealing region 140B between the body elements 110A, 110B may be formed by RF welding, thermal sealing, gluing, or bonding, or other technique that is used to bond the materials used to form the body element 110 (e.g., urethane materials, rubber, elastomeric materials, polymeric materials, composite materials). One or more sealing element 140A may be provided at suitable locations on the body elements 110A, 110B to hold the device 100 in a desired position on the extremity.

Figure 2B:
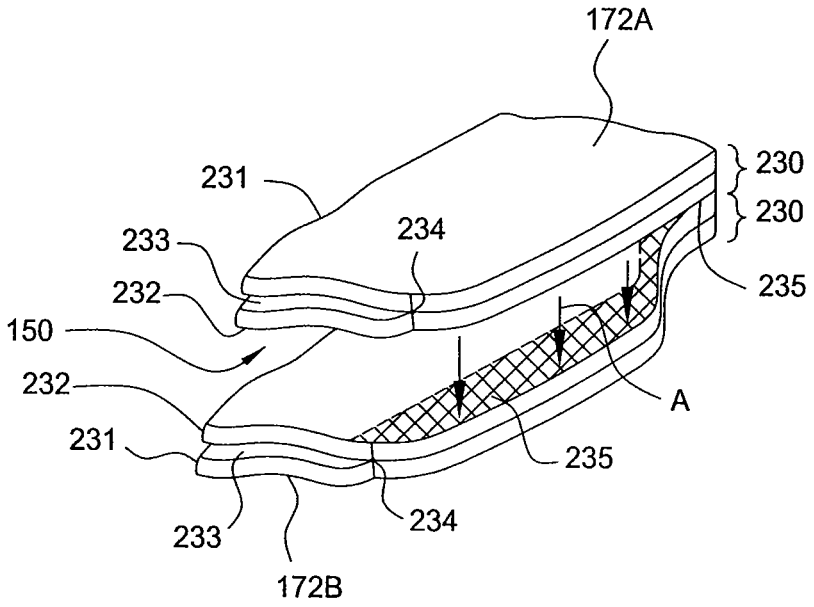
FIG. 2B is a close-up partial exploded view of a portion of the gas plenums illustrated in FIG. 2A, according to one embodiment of the invention.

In one embodiment, as shown in FIG. 2B, each of the gas plenums 172A and 172B are each formed by bonding or sealing two layers (e.g., layers 231 and 232) of a collapsible and pliant material together to form a composite element 230. FIG. 2B is a partially exploded cross-sectional view of a portion of the gas plenums 172A and 172B according to an embodiment of the invention. The formed gas plenums 172A and 172B each have a fluid plenum 233 formed between the bonded and sealed layers (e.g., layers 231 and 232) to allow a fluid delivered by the pump 163 to enter and pressurize the space within the fluid plenum 233. The layers 231 and 232 can be sealed (e.g., seal 234) by use of a heat sealing, gluing, or other conventional compliant layer bonding technique to form an enclosed and sealed fluid plenum 233. The two or more composite elements 230 can then be bonded together (see "A" in FIG. 2B) at a sealing region 235, using a heat sealing, gluing, or other conventional technique, to form the space 150 in which the extremity 130 can be placed. In use the pump 163 is used to deliver fluid to cause at least one of the fluid plenums 233 formed in either of the gas plenums 172A and 172B to pressurize and cause the layer 232 in the affected gas plenum to expand and apply a pressure to the extremity of a mammal disposed in the space 150 formed between the gas plenums 172A and 172B. The layers 231 and 232 may be composed of a collapsible and pliant material, including but not limited to, urethane, polyurethane, polypropylenes, polystyrenes, high density polyethylene's (HDPE), low density polyethylene's (LDPE), poly(vinyl chloride), rubbers, elastomers, polymeric materials, composite materials, among others. The thickness of the collapsible and pliant material used to form the gas plenums is not limited as long as it can sustain the pressurized conditions when they are pressurized to level of between about 1 mmHg to about 15 mmHg. For example, a urethane material having thickness of from about 0.5 mils to about 20 mils, such as about 1.5 mils to about 12 mils, can be used to pliantly conform to the shape and size of the portion of the extremity 130 disposed in the space 150.

In one embodiment, the thermal exchange units 120A, 120B are detachably attached to the body elements 110A, 110B on at least one surface or side. The opposing side of the thermal exchange units 120A, 120B is provided and designed to efficiently and comfortably contact the extremity of a mammal to provide thermal exchange with the extremity disposed within the space 150. In operation, the body elements 110A, 110B, the thermal exchange units 120A, 120B are assembled to receive a portion of the extremity of a mammal into the space 150. In one embodiment, one or more thermal exchange units can be pre-assembled inside the devices. In another embodiment, one or more thermal exchange units can be assembled into the devices prior to use.

Figure 3A:
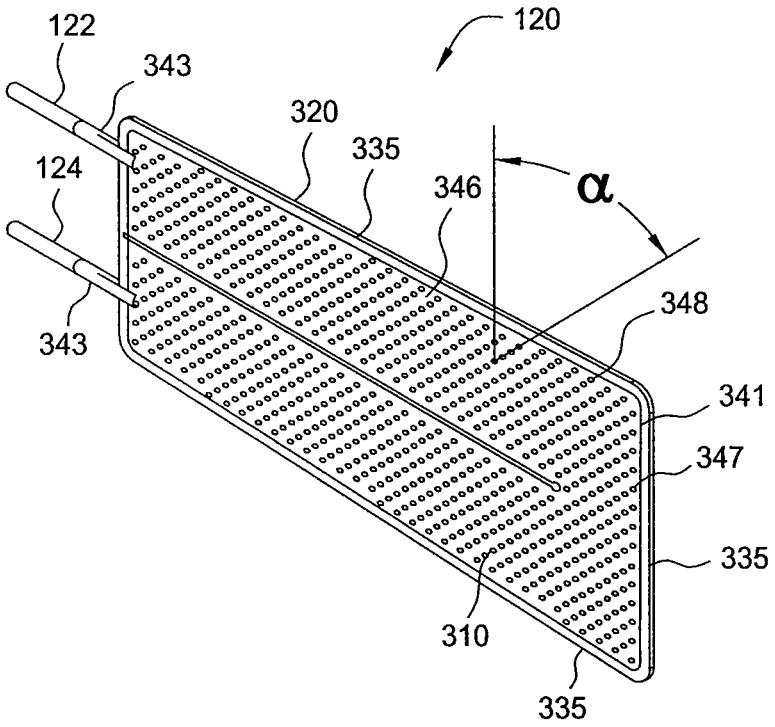
FIG. 3A illustrates one example of a thermal exchange unit according to one embodiment of the invention.
Figure 3B:
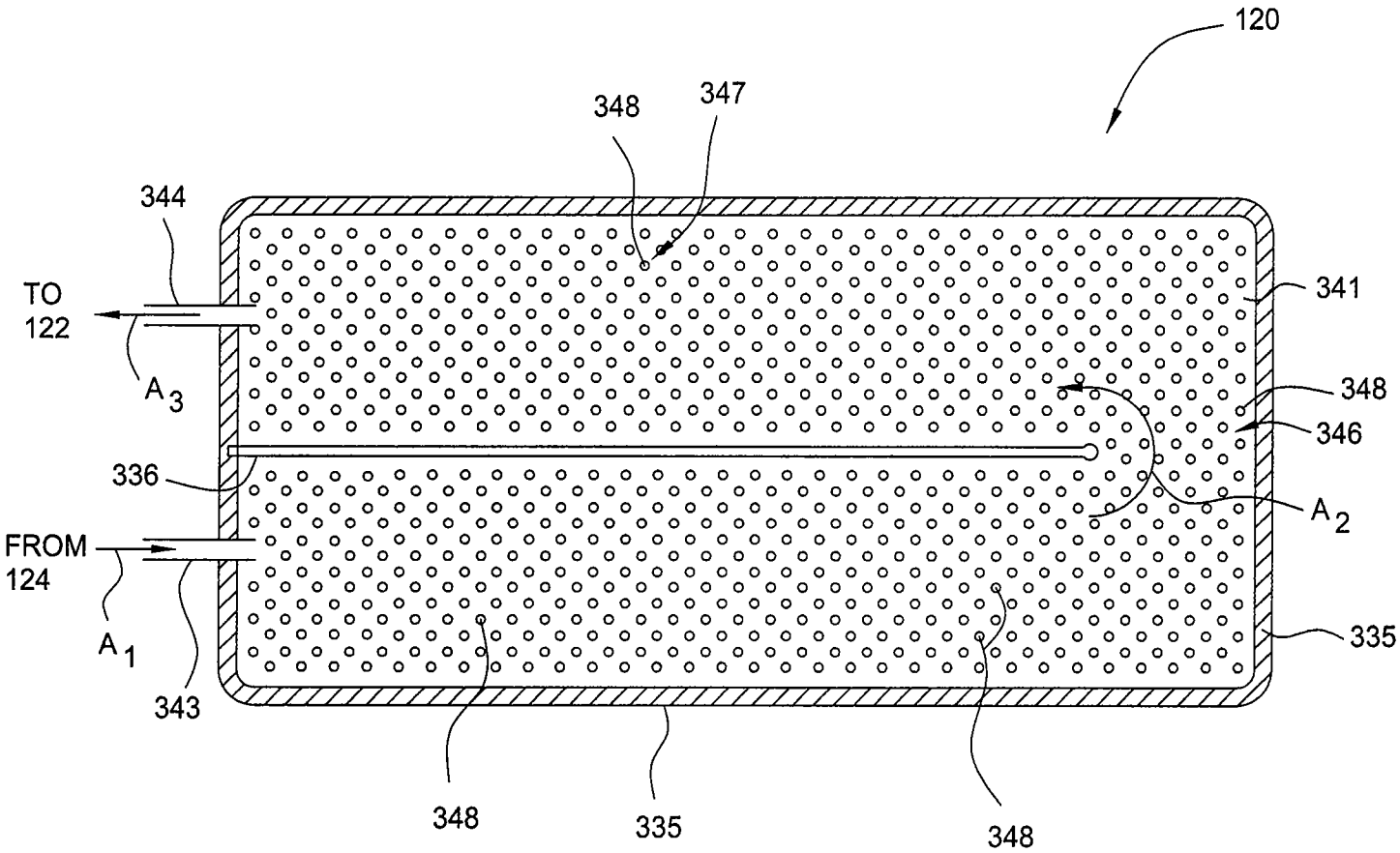
FIG. 3B illustrates another example of a thermal exchange unit according to one embodiment of the invention.

FIGS. 3A-3B illustrates an embodiment of the thermal exchange units 120A, 120B that are formed using two layers of a compliant material 341 that are sealed at the edge region 335 by use of an RF welding, thermal sealing, gluing or other bonding process to form a sealed thermal exchange body 346. FIG. 3A illustrates one example of a thermal exchange unit 120 according to one embodiment of the invention. The thermal exchange unit 120 includes a thermal exchange body 346. One side 320 of the thermal exchange body 346 is provided to receive pressurized compression forces exerted from the gas plenum 172 of the body element 110. Another side 310 of the thermal exchange body 346 is provided to contact a portion of the extremity and includes a plurality of thermal contact domes 348.

The thermal exchange body 346 may have an inlet port 344 and an outlet port 343 that are in fluid communication with the fluid source 161, and the fluid return line 122 and fluid supply line 124, respectively. The region formed between the two layers of the compliant material 341 is thus used as a fluid plenum that can receive (see arrow $A_1$) and then exhaust (see arrow $A_3$) the thermal fluid medium delivered from the fluid source 161 (FIG. 3B). In one embodiment, a separating feature 336 is formed in the thermal exchange unit to separate the fluid delivered into the inlet port 344 and the outlet port 343, and thus allow the thermal exchanging fluid to follow a desirable path through fluid plenum to optimize and/or improve efficiency of the heat transfer process. In one example, the fluid flow path sequentially follows the arrows $A_1$, $A_2$ and $A_3$. The separating feature 336 can be formed in the sealed thermal exchange body 346 by RF welding, thermal sealing, gluing or other bonding process to bond the two layers of the compliant material 341 together. In one embodiment, the thermal exchange unit 120 is formed and assembled through RF welding or thermal sealing techniques. In another embodiment, the thermal exchange unit 120 may be formed and assembled through injection molding. In one embodiment, the thermal exchange unit 120 illustrated in FIGS. 3A-3B is formed from a pliant material, including but not limited to, urethane, polyurethane, polypropylenes, polystyrenes, high density polyethylene's (HDPE), low density polyethylene's (LDPE), poly(vinyl chloride), rubbers, elastomers, polymeric materials, composite materials, among others. In one embodiment, the thermal exchange unit 120 can be formed and assembled through RF welding. In another embodiment, the thermal exchange unit 120 may be formed and assembled through injection molding. There are many possible ways to design and manufacture the thermal exchange unit to provide a flexible thermal exchange unit that does not leak.

In one embodiment, a plurality of domes 348 are formed between the layers of compliant material 341 in the sealed thermal exchange body 346 by RF welding, thermal sealing, gluing or other bonding process to form a structure that will not expand when a heat exchanging fluid is delivered to the internal region of the sealed thermal exchange body 346. Each thermal contact dome 348 includes a thermal contact surface 347 to be in direct contact with the extremity. The diameter of the thermal contact surfaces 347 and the shapes or sizes thereof can vary such that the sum of the total area of the thermal contact surfaces 347 can be increased to a maximum. The thermal exchange unit 120 may further include the fluid supply line 124 and the fluid return line 122 connected to a thermal fluid source for circulating a thermal fluid medium there through the thermal exchange body 346 of the thermal exchange unit 120.

In one embodiment, the thermal contact domes 348 are points or regions in the thermal exchange units 120 where the layers of compliant material 341 are bonded or welded together to form restrictions or obstructions in the flow path (e.g., arrow $A_2$) through the thermal exchange unit 120. By arranging the placement of the obstructions in the flow path it is believed that the thermal exchange between the fluid flowing through the thermal exchange unit 120 and the extremity of the patient can be improved. In one embodiment, the fluid flow through the thermal exchange unit 120 is controlled so that it is substantially turbulent to maximize the transfer of heat between the flowing fluid and the compliant material 341 that is in contact with the extremity. In one example, a flow of 1 liter per minute of 43° C. water is delivered through an average area of about 0.060 $in^2$ (38.7 $mm^2$) to achieve a turbulent flow within the thermal exchange unit 120. The average area is generally the cross-sectional area measured in a region formed between the edge region 335, the separating feature 336, and the space formed between the layers of compliant material 341. While in this configuration the thermal contact domes 348 are actually depressions formed in the layers of compliant material 341, it is believed that sufficient thermal contact can be achieved between the regions of compliant material 341 that are positioned between the thermal contact domes 348 and the extremity of the patient. It is desirable to assure that equal and even contact is created between the compliant material 341 and the extremity of the patient to assure that an efficient exchange of heat is created between the thermal exchange unit 120 and the extremity of the patient.

FIG. 3B illustrates an example of the thermal exchange unit 120 having a plurality of thermal contact domes 348 arranged in optimized spatial relationship. It has been found that optimal thermal exchange can be obtained when the thermal contact domes 34 are arranged to include an angle α formed among at least three thermal contact domes 348. The angle α can be optimized to range between 30° to about 75°, preferably about 45°. In one example, the nearest neighbor spacing between each thermal contact dome 348 is about 8 mm to about 9 mm and the distance between the edge region 335 and the separating feature 336 is between about 70 mm and about 80 mm.

In one aspect, it is desirable to design the thermal exchanging unit 120 so that the maximum exchange of heat will occur during the operation of the device 100.

In one embodiment, the thermal contact domes 348 are made of a separate rigid material, such as a metal, conductive plastic, or other similar material, to provide good thermal and physical contact to the extremity. The material of the thermal contact domes 348 may be a material which provides high thermal conductivity, preferably much higher thermal conductivity than the material of the thermal exchange main body 346. For example, the thermal contact domes 348 may be made of aluminum and are attached to the thermal exchange main body 346. Domes made of aluminum will provide at least 400 times higher thermal conductivity than a plastics or rubber material. An example of an exemplary thermal exchange unit having thermal contact domes made of a highly conductive material is further described in the commonly assigned U.S. patent application Ser. No. 11/870,780, filed Oct. 11, 2007, which is herein incorporated by reference. However, in some cases thermal exchange units that are manufactured from two or more layers of materials bonded together to form internal fluid flow paths may result in uneven surfaces or bumpy surfaces that provide less thermal contact, thereby reducing surface area needed for maximum thermal transfer. In addition, the material for the thermal exchange body 346, such as polyurethane, etc., is generally may not be good conductor for thermal transfer. Thus, the thermal exchange body 346 may be covered by one or more backing sheets such that flat and even contact surfaces to the extremity, resulting in a large total contact area, can be provided. In addition, the backing sheet can be made of high thermal conductive material to provide high thermal conductivity between the thermal exchange unit 120 and the extremity. For example, the backing sheets may be made of a thin metal sheet, such as aluminum (like a foil) or other metal sheets. In general, aluminum or other metal materials may provide higher thermal conductivity than plastics or rubber, e.g., at least 400 times higher.

Alternatively, one or more thermal exchange units 120A, 120B may be an electric pad having one or more electric wires connected to a power source. For example, the power source may be a low voltage DC current power source. In addition, the one or more thermal exchange units may include a thermocouple to monitor the temperature and a thermo switch to automatically shut off the electric power when the temperature of the electric pad passes a safety level.

The thermal exchange units as described herein according to embodiments of the invention generally provide thermal exchange surfaces, with increased surface area, to heat, cool, and/or regulate the temperature of an extremity of a mammal. The thermal exchange units can be used to regulate the blood flow in an appendage by a variety of means. For instance, applying a temperature to a hand at about 0° C. to 10° C. can cause an increase in the average blood flow due to a phenomenon called the "hunting response" which keeps hunters and fisherman from getting frostbite while working in the extreme cold with their bare hands. Different individuals respond differently to cold applied to the hands, and in a some well known laboratory tests, application of cold to the hands of a person from the Indian sub-continent improved average blood flow, but not as much as the same treatment improved the average blood flow in the typical Eskimo.

In some cases, the perception of warmth is enough to improve blood flow. For instance, a 23° C. (room temperature) water pad feels cool in intimate contact with the leg of a normothermic subject who otherwise feels warm, and the "COOLNESS" of the pad can measurably reduce blood flow in the leg. However, if the same person's leg has been exposed to 5° C. cold for prolonged periods, this same 23° C. (room temperature) water pad feels warm in comparison, so that it can actually increase blood flow in the same leg. Therefore the temperature blood flow relationship is determined by both perceived warmth and applied temperature. The application of the heat above the core body temperature is also able to increase blood flow. One desirable feature of one or more of the embodiments of the invention described herein, is the improved patient comfort and feeling of warmth felt by patient during the process of controlling the temperature of the patient's core over other prior art designs. In one embodiment, the improved comfort and feeling of warmth are believed to be created by the act of isolating, such as at least partially enclosing, the patient's extremity and placing it in intimate contact with a temperature controlled thermal exchange unit.

In addition, the thermal exchange unit 120 may include one or more temperature sensors and thermocouples to monitor the temperature of a mammal's extremity and provide temperature control feedback. For example, a tympanic temperature probe may be inserted to other body portions, such as ear canal, etc., of a mammal to monitor core body temperature and provide the core temperature feedback to the controller 160.

Figure 4A:
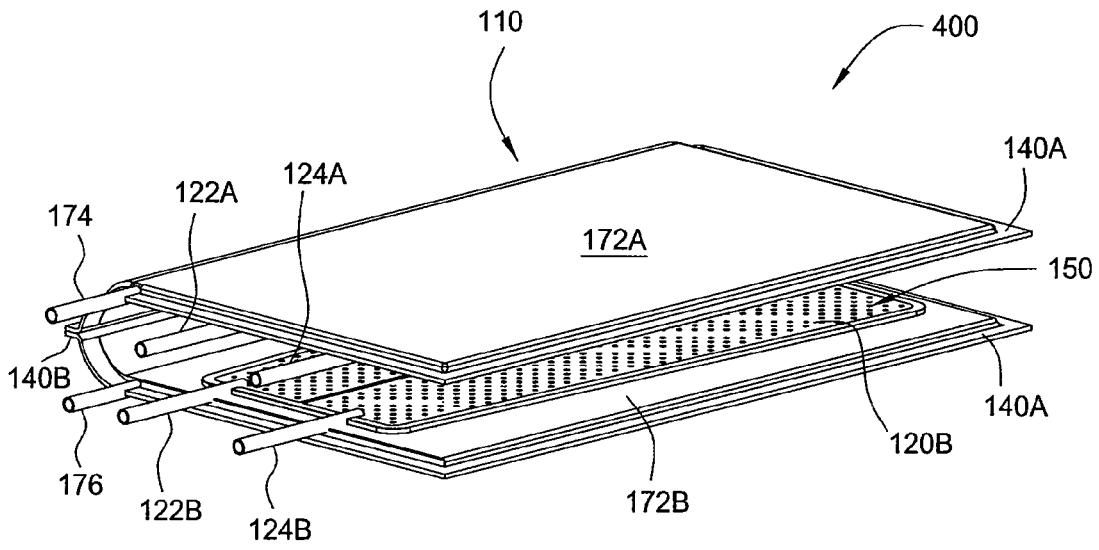
FIG. 4A is a perspective view of another exemplary device which can be used to enclose an extremity according to one embodiment of the invention.
Figure 4B:
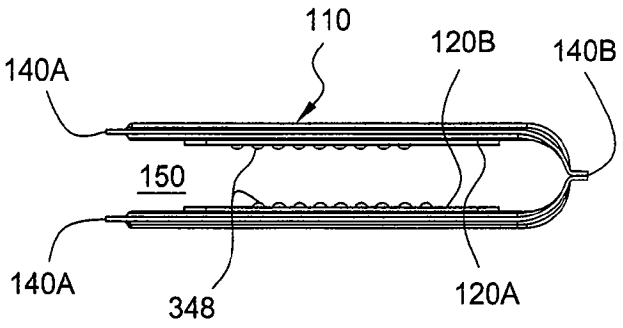
FIG. 4B is a cross-sectional view of the exemplary device of FIG. 4A according to one embodiment of the invention.
Figure 4C:
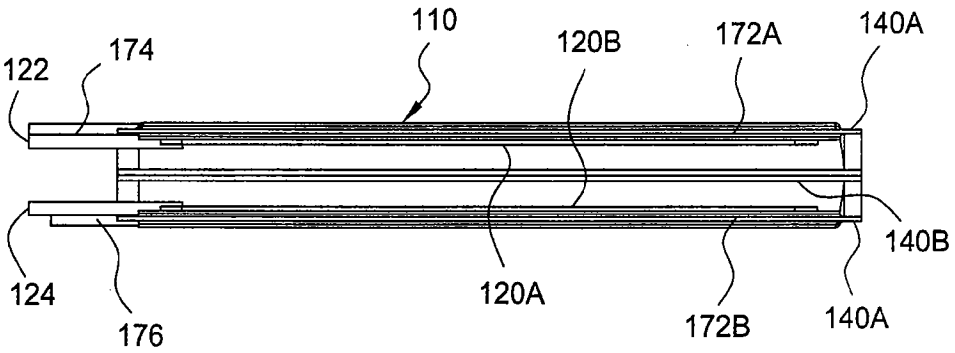
FIG. 4C is a cross-sectional view of the exemplary device of FIG. 4A from a direction different from that of FIG. 4B according to one embodiment of the invention.

FIG. 4A is a perspective view of an example of a device 400. FIGS. 4B-4C are side views of a device 400. The device 400 is similar to the device 100 illustrated in FIGS. 1-3B, except, as shown in FIGS. 4A-4C, only one side the device 400 is joined together to allow the compliant one or more gas plenums 172A, 172B and thermal exchanging units 120A, 120B to unfolded so that an extremity of a mammal can be more easily positioned in the space 150 formed there-between. The device 400 includes one body element 110 made of collapsible and pliant materials to provide the space 150 into which an extremity of a mammal can be inserted. The body element 110 is generally flat or occupying a minimized space or volume such that the device 400 can be conveniently folded, stored, or shipped. In one embodiment, the body element 110 can be formed by bonding one side of the device 400 at a sealing region 140B formed between two or more gas plenums 172A, 172B.

The device 400 may optionally include the thermal exchange units 120A and 120B, the fluid supply lines 124A, 124B, and the fluid return lines 122A, 122B. Once an extremity is disposed into the space 150, the device can be sealed by mating the sealing element 140A attached to gas plenums 172A and sealing element 140A attached to gas plenums 172B together. The fluid supply ports 174, 176, the fluid supply lines 124A, 124B, the fluid return lines 122A, 122B can optionally be connected to the manifold 114 for conveniently connecting the various fluid sources, gas sources, and/or pumps.

Figure 5A:
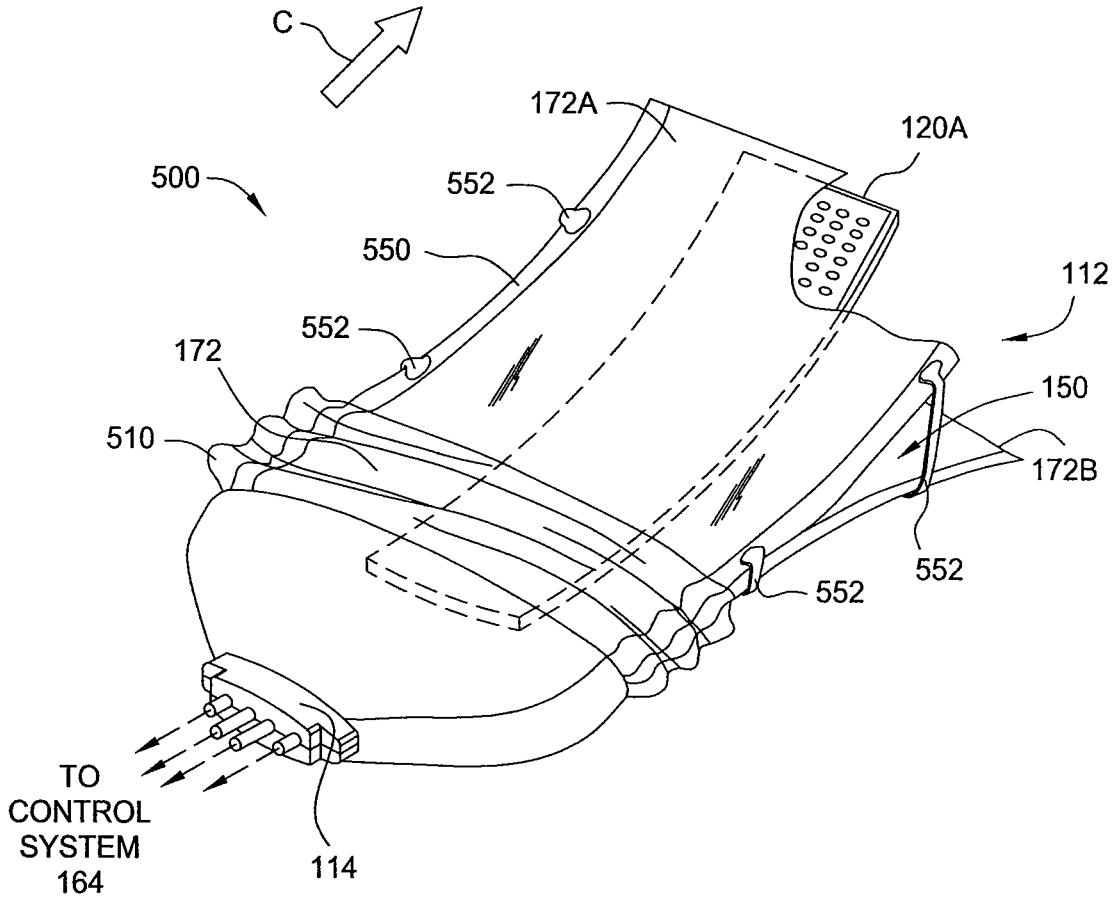
FIG. 5A is a top view of an exemplary device enclosed with a human extremity according to one embodiment of the invention.
Figure 5B:
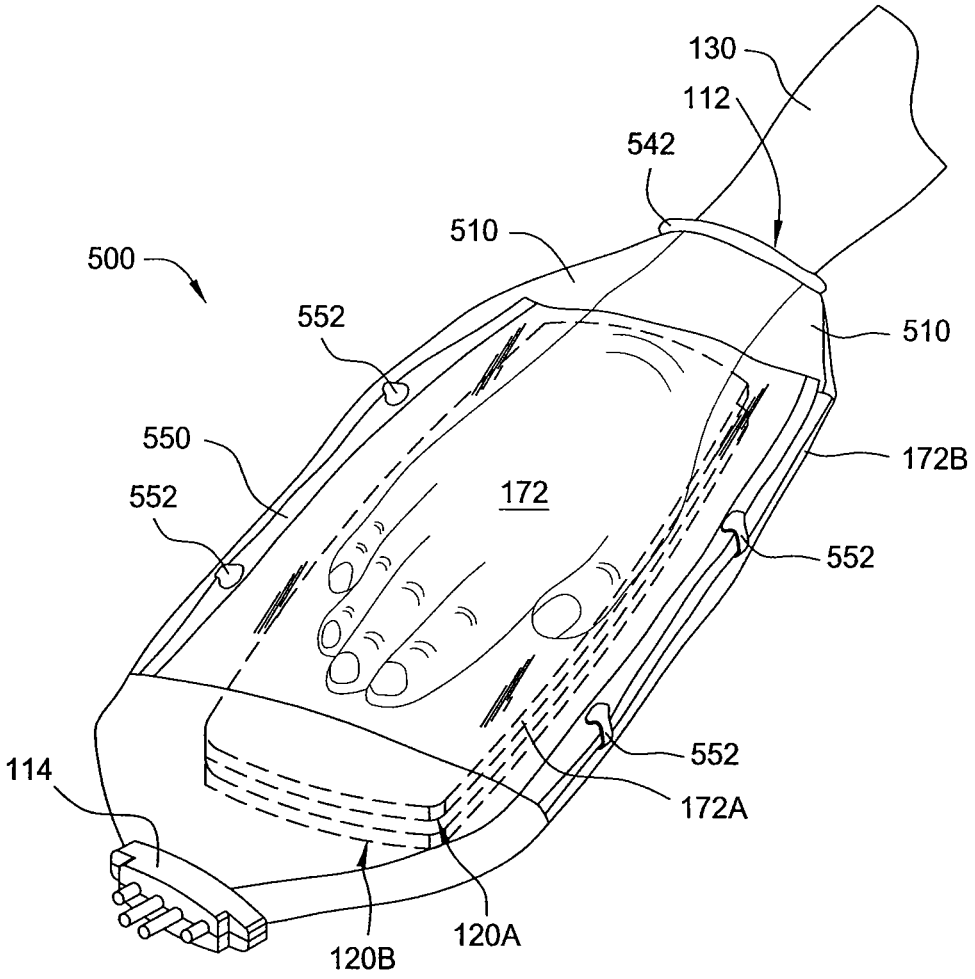
FIG. 5B is a top view of another exemplary device to be folded prior to enclose an extremity according to one embodiment of the invention.

FIG. 5A is a partial isometric section view of another device 500 according to one embodiment of the invention that is in an "open" position to receive an extremity 130 (see FIG. 5B). FIG. 5B illustrates the device 500 which is configured to enclose a portion of the extremity 130 disposed therein according to one embodiment of the invention. The device 500 includes a body element 510 which can be folded and/or rolled up and down to form the opening 112 to enclose a portion of the extremity 130 of a mammal. The body element 510 may be comprised of the same material as the body element 110 of the device 100. In addition, the device 500 may further include one or more gas plenums 172A, 172B, one or more thermal exchange units 120A and 120B (only one shown in FIG. 4A), which are capable of containing a thermal-exchange fluid medium therein.

Referring to FIG. 5B, the size of the opening 112 formed when the extremity 130 is enclosed within the device 500, may be sealed by use of a sealing element 542. The material of the sealing element may be the same material as the sealing element 140.

In operation, the device 500 is unfolded and folded according to the direction of an arrow C to cover and enclose the thermal exchange units 120A and 120B and the extremity 130. FIG. 5B illustrates the device 500 in an enclosed configuration. In one embodiment, during the process of enclosing the extremity 130, the edges 550 of the gas plenums 172A, 172B may be urged together by one or more enclosing clip 552 and the opening 112 can be formed for the portion of the extremity 130 to be inserted therein. The mechanism by which the enclosing clips 552 can be used to enclose the edges 550 may include fasteners, zippers, snaps, hydrogel coated tabs, conventional tapes, buttons, and hook/loop type systems, among others. For example, the edges 550 of the gas plenums 172A, 172B may be reinforced such that the edges 550 can be sealed and snapped-locked tightly by the enclosing clips 552. Further, a manifold 114 can be used to bundle up the various fluid lines and pressure lines together that are connected to the controller 160, the fluid source 161, pressure sensor 162 an/or a pump 163 (FIG. 1).

Figure 6A:
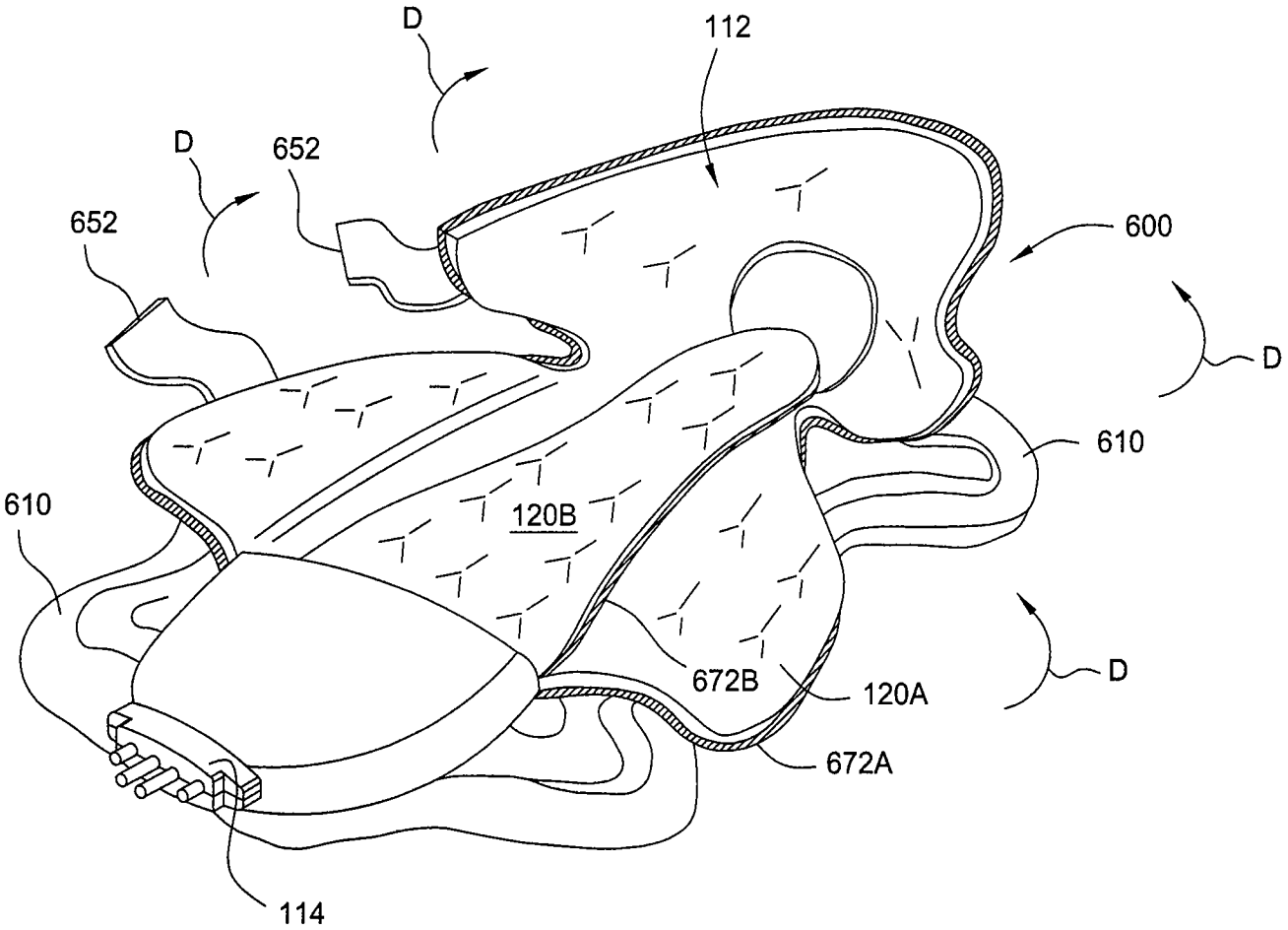
FIG. 6A is a top view of an exemplary lower extremity device which is not yet folded nor enclosed according to one embodiment of the invention.
Figure 6B:
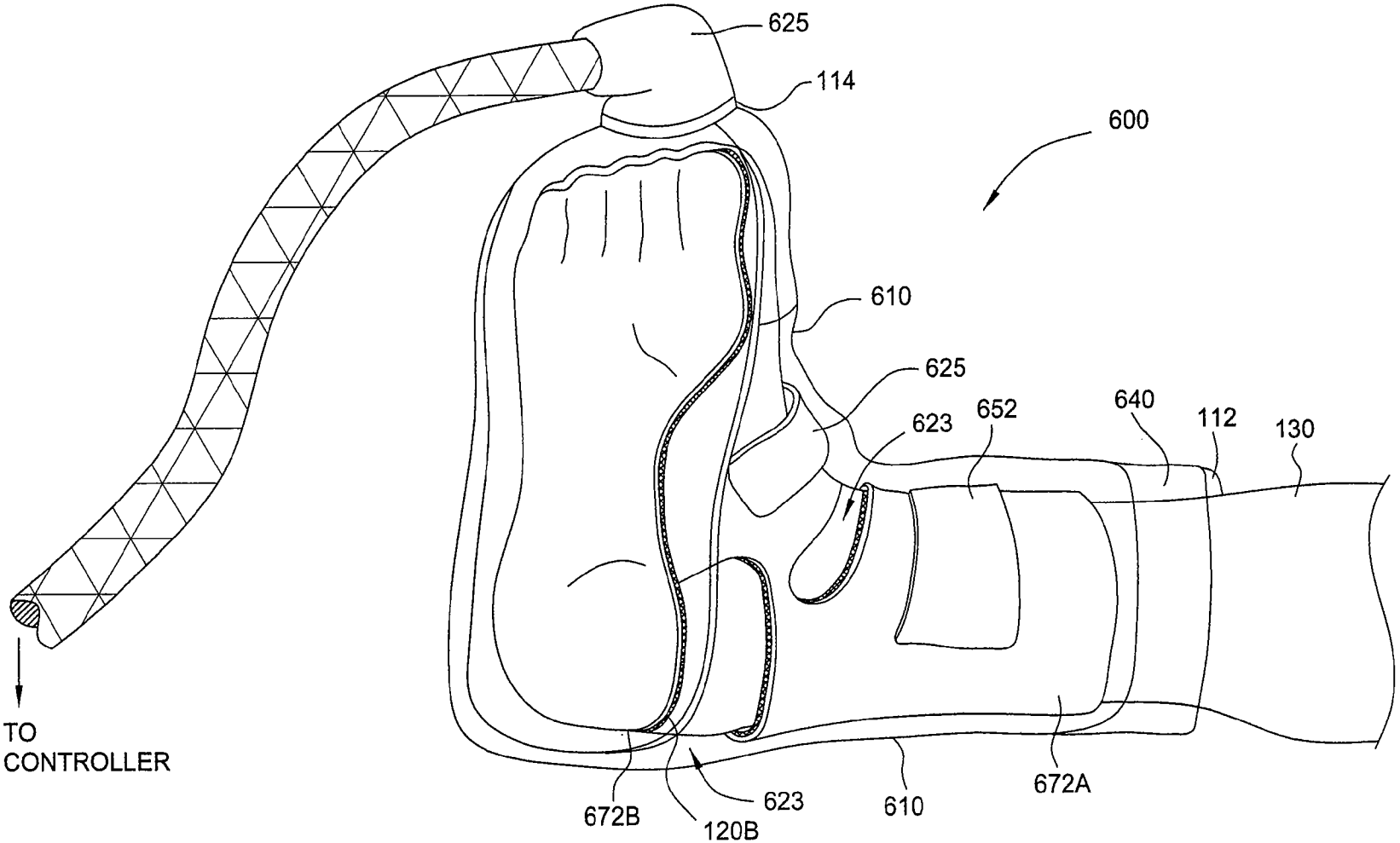
FIG. 6B is a perspective view of an exemplary lower extremity device which is not yet folded nor enclosed according to one embodiment of the invention.

FIG. 6A is an isometric view of an exemplary lower extremity device which is not yet folded nor enclosed by the body element 610. More specifically, FIG. 6A is an isometric view of one example of a device 600 that is used to control the temperature of human by controlling the transferring heat and applying pressure to a persons foot. FIG. 6B is a perspective view of an exemplary lower extremity device which is folded, enclosed and sealed according to one or more embodiments of the invention. The device 600 may include a singular body element 610 capable of laying flat, rolled and/or unfolded, as shown in FIG. 6A. Alternatively, the device 600 may include more than one body elements 610. The device 600 includes the opening 112 for containing a lower extremity of a mammal therein. The device 600 also includes a body element 610 for forming into a plurality of gas plenums 172A, 172B. Gas or air can be supplied into the pressure-applying gas plenums 672 for applying pressurized compression forces to the extremity.

In addition, the device 600 further includes one or more thermal exchange units 120A and 120B capable of containing a thermal-exchange fluid medium therein. The body element 610 and the thermal exchange units 120A, 120B can be folded, for example, through the direction of arrows D, to enclose a portion of the extremity 130 of a mammal. In operation the device 600 is folded by securing the positions of the gas plenums 672A, 672B and the thermal exchange units 120A, 120B and adjusting accordingly to the size of the extremity 130. The gas plenums 672A, 672B and thermal exchange units 120A, 120B and the body element 610 can be properly folded, secured, and/or adjusted through one or more enclosing clips 652 located on one or more positions on the thermal exchange units 120A, 120B and the body element 610. The one or more enclosing clips 652 can be, for example, Velcro type fasteners, as shown in FIGS. 6A and 6B, or another other suitable, clips, fasteners, zippers, snaps, tabs, tongs, adhesives, hydrogel coated tabs, conventional tapes, buttons, occlusion cuff, hook/loop type systems, etc. before or after a leg is positioned therein. Next, the body element 610 can then be positioned over the gas plenums 672A, 672B and thermal exchange units 120A, 120B to form the opening 112 (see FIG. 6B) in which the extremity 130 is disposed. The size of the opening 112 may be sealed by the sealing element 640 (FIG. 6A).

The gas plenums 672A, 672B, which are similar to the gas plenums 172A, 172B shown in FIG. 1-3B, are capable of expanding to be filled with air or gases. The body element 610 may be comprised of the same collapsible and pliant material as the body element 110, such as a transparent or semi-transparent material that allows viewing of the extremity 130 positioned therein. The body element 610 may be collapsible and pliant such that it is capable of expanding into pressure-applying gas plenums 672A, 672B. Accordingly, the materials of the body element 610 and the thermal exchange units 120A, 120B are made of a flexible material, which can be pliant and easily collapsible to conform into the shape of a lower extremity and securely surround and enclose the portion of the lower extremity. The material for the thermal exchange units 120A, 120B and the body element 610 are comprised of collapsible and pliant material to enhance the surface contact between the thermal exchange units 120A, 120B and the lower extremity. The material may sustain expansion or compression under pressurized compression forces. Thus, good surface contact is provided between the surfaces of the lower extremity and the thermal exchange units 120A, 120B and/or between the body element 610 and the space 150 for receiving the extremity within the device 600 is minimized.

Further, a generalized port 625 (FIG. 6B) can be used to bundle up various fluid ports and pressure ports together and connected to the controller 160, the fluid source 161, pressure sensor 162 an/or a pump 163. The one or more tubing's, lines, and ports can be bundled together and connected to the manifold 114 for connecting to thermal regulation fluid sources, vacuum pumps, and/or a controller unit (not shown) for easy transportation and easy connection. As shown in FIGS. 6A and 6B, the manifold is convenient located to near the front toe portions of a foot.

Referring to FIG. 6B, in one embodiment, the body element 610 and/or thermal exchange units 120A, 120B contain one or more relieved regions 623 that allow for movement of the extremity 130 during the use of the device 600. The placement of the relieved regions 623 in the thermal exchange units 120A, 120B may be strategically positioned to only allow heat transfer to desired regions of the extremity 130. It has been found that exchanging heat with certain areas of certain extremities can be unpleasurable. For example, it has been found that providing heat to the heal region of a foot can be an unpleasurable experience for some subjects, and thus, as shown in FIG. 6B, the heal region of the thermal exchange units 120A, 120B has been removed to form the relieved region 623 at the heel. In one embodiment, the heat transfer portion of the thermal exchange units 120A, 120B near the heal region is removed to remove or prevent the process from being unpleasant.

The thickness of the collapsible and pliant material used to form the gas plenums 672A, 672B is not limited as long as it can sustain the pressurized conditions when the gas plenums 672A, 672B are filled with a fluid at a pressure level of between about 1 psi to about 15 psi. The thickness of the gas plenums 672A, 672B is not limited as long as it can sustain the pressurized conditions when the device 600 is used; for example, a thickness of from about 0.5 mils to about 20 mils, such as about 1.5 mils to about 12 mils, can be used to pliantly conform to the shape and size of the portion of the extremity 130 contained therein. In one example, a urethane material having a thickness from about 1.5 mils to about 12 mils can be used to pliantly conform to the shape and size of the portion of the extremity 130 contained therein.

The thermal exchange units 120A, 120B can be permanently or detachably placed inside the device 600 to provide thermal exchange for the extremity 130 received therein. One example of the thermal exchange units 120A, 120B is illustrated in FIGS. 3A-3B. A thermal-exchange fluid medium, such as heated fluid, heated air, cooled fluid, or cooled air, etc., can be delivered from a fluid source (not shown) into and out of the thermal exchange units 120A, 120B via one or more fluid supply lines and one or more fluid return lines. For example, the thermal exchange units 120A, 120B may be a water heating pad having heated water delivered therethrough. Alternatively, the thermal exchange unit may include an electric pad, as described in detail in the commonly assigned U.S. patent application Ser. No. 11/870,780, filed Oct. 11, 2007, and the U.S. provisional patent application Ser. No. 60/821,201, filed Aug. 2, 2006, which are both incorporated by reference herein.

A sealing elements may be used to seal various components of the device and secure the portion of the lower extremity when placed through the opening 112 and inside the space 150 such that a pressure can be applied to the extremity. The sealing element 640 may be used to seal the opening 112 according to the size of the portion of the lower extremity of the mammal. The sealing element 640 may be made of the same material as the sealing element 140 and can be attached or detachably attached to the opening 112.

Figure 6C:
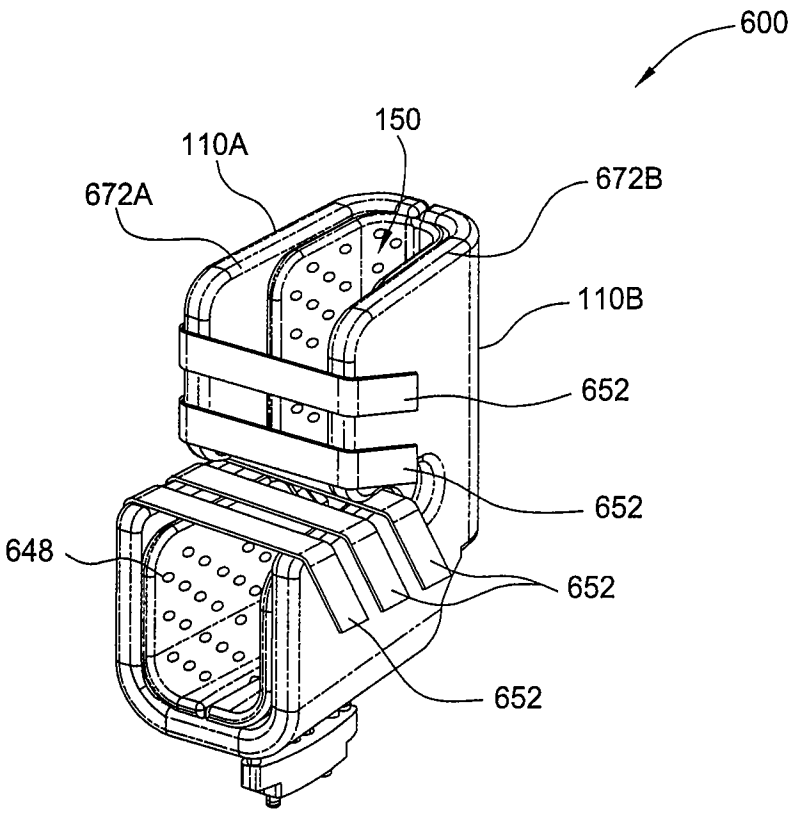
FIG. 6C is a perspective view of an exemplary lower extremity device according to one embodiment of the invention.
Figure 6D:
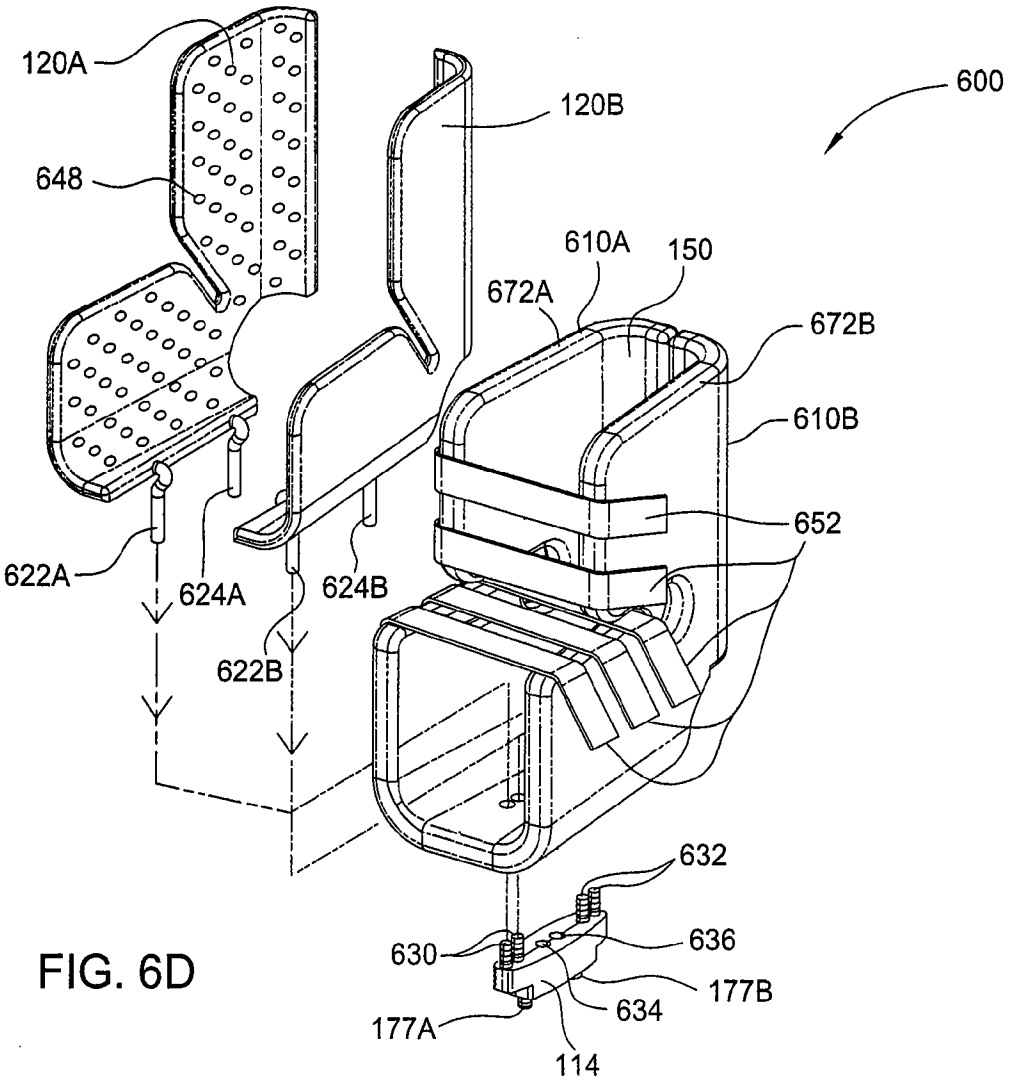
FIG. 6D is a perspective view of an exemplary lower extremity device which is folded and sealed according to one embodiment of the invention.

FIG. 6C is an isometric view of another exemplary lower extremity device 600. FIG. 6D is an isometric exploded view of the device 600 shown in FIG. 6C. The device 600 may include a body element 610A and a body element 610B having a plurality of pressure-applying gas plenums 672A, 672B. The body elements 610A, 610B can generally be flat or occupying a minimized space or volume such that the device 600 can easily and conveniently be folded, stored, or shipped.

In one embodiment, the body elements 610A, 610B also contain one or more thermal exchange units 120A, 120B that are attached or positioned within the space 150 formed between body elements 610A, 610B. The thermal exchange units 120A, 120B, once positioned on the body elements 610A, 610B, are adapted to contact portions of the lower extremity (e.g., foot and calf of human) when a fluid is supplied into the gas plenums 672A, 672B so that pressure can be applied to the lower extremity of the mammal. The thermal exchange units 120A, 120B include a plurality of thermal contact domes 648 for directly contacting the portions of the lower extremity so that heat can be efficiently exchanged when compression forces are applied to the extremity by the gas plenums 672A, 672B. The compression forces that are applied to the lower extremity can be adjusted by varying the pressure level of the fluid delivered into the gas plenums 672A, 672B. In general, a pressure level of between about 5 mmHg to about 25 mmHg can be applied. The temperature of the lower extremity received inside the space 150 can be increased, reduced, or maintained by adjusting the temperature of the thermal fluids delivered into the thermal exchange units 120A, 120B.

A thermal-exchange fluid medium, such as heated fluid, heated air, cooled fluid, or cooled air, etc., can be delivered from a fluid source (not shown) into and out of the thermal exchange units 120A, 120B via one or more fluid supply lines 624A, 624B, and one or more fluid return lines 622A, 622B. The manifold 114 may be connected to one or more fluid supply lines 624A, 624B, and one or more fluid return lines 622A, 622B by use of the a supply line 630 and a supply line 632 located on the manifold 114. The manifold may include internal fluid channels such that a fluid ports 177A, 177B on the manifold 114 can be fitted and connected to the plurality of the supply lines 630, supply lines 632 as well as to the fluid supply lines 624A, 624B and the fluid return lines 622A, 622B of the thermal exchange units 120A, 120B. The manifold 114 may also be connected to one or more gas supply lines for supplying gas or air into the pressure-applying gas plenums 672A, 672B via one or more gas line 634, 636.

A plurality of enclosing clips 652 may be used to seal various components of the device and secure the portion of the extremity when placed through the opening 112 and inside the space 150. The enclosing clips 652 can be, for example, Velcro type fasteners, or another other suitable, clips, fasteners, zippers, snaps, tabs, tongs, adhesives, Velcro, buttons, occlusion cuff, hook/loop type systems, etc. before or after a lower extremity, a foot, or a leg is positioned therein.

In operation the device 600 the lower extremity disposed in the space 150 formed between body elements 610A, 610B so that the thermal exchange units 120A, 120B can be contact at least a portion of the extremity. The body elements 610A, 610B can then secured around the extremity by use of the enclosing clips 652 to provide a desirable fit. The temperature of the patient can then be controlled by pressurizing the gas plenums 672A, 672B, which causes the thermally controlled thermal exchange units 120A, 120B to be urged against the surface of the extremity, and thus exchange heat with the extremity and the temperature controlled thermal exchange units 120A, 120B. The device 600 may also be extended to different sizes of a mammal's feet, legs, limbs, etc. For example, the device 600 may include one or more body elements 610 with one or more thermal exchange units 120 attached thereto, such as an upper body element with pressure-applying gas plenums is attached to the foot portion of a leg and a lower body element with pressure-applying gas plenums is attached to the calf portions up to or near a knee of a leg. Alternatively, one single body element of the device 600 can be provided for the whole leg portion of a mammal.

FIG. 7 illustrates an example of a manifold 714 having one or more fittings that are used to connect the various gas, fluid lines to various components internal and external to the device 700 according to one or more embodiments of the invention. The manifold 714 can be attached to the body element, gas plenums, and thermal exchange units of the device through one or more apertures on the body elements and the thermal exchange units. FIG. 7 is a partial cut-away view that schematically illustrates a device 700 that contains the various components discussed herein in conjunction with the device 100, 400-600 and 800-1000, and the manifold 714 is generally useful in any of the configurations discussed herein in. In one aspect, the manifold 714 is used in place of the manifolds 114 and 625 discussed above.

The manifold 714 generally contains one or more fluid ports or pressure ports, such as pressure ports 716, 718, a fluid supply line 724, and a fluid return line 722, which can be connected to the manifold body 715 or integrally formed using injection molding, heat stacking, adhesives or other manufacturing methods. Accordingly, quick connect fittings or connectors can be incorporated to provide a connection point to interface the thermal exchange units, gas plenums, fluid pads, other heating components, electric pads, vacuum lines, pressure sensing lines, etc. For example, the manifold 714 may include connectors 730, 732, 734, 736, such as a quick connect type connector similar to CPC Colder Products Company in St, Paul, Minn. In operation, the vacuum space formed in the device 700 requires a robust and airtight seal so that the thermal heat transfer fluids and/or air external to the device doesn't affect the operation of the process. The manifold 714 can be made out of injection molded plastic materials for its low cost, or any other suitable materials. A seal is generally formed between the manifold 714, the various one or more fluid ports or pressure ports (e.g., reference numerals 716, 718), and the body element 710 (e.g., similar to body elements 110, 510) to allow a desired pressure to be reached in the gas plenums 172A, 172B of the device 700 by use of the pump 163. The seal formed between the body element 710 and the various components of the manifold 714 can be created using conventional adhesives, mechanical force, or o-rings to name just a few.

As shown in FIG. 7, the manifold 714 may be connected to the inlet of the thermal exchange units 720A and 720B, which are similar to the devices discussed in conjunction with FIG. 3A-3B, using the fluid supply line 724 through one or more fluid supply fittings 754 and conventional tubing 753 that is in fluid communication with the connector 732 and the fluid supply line 161A of the fluid source 161. The outlet of the thermal exchange units 720A and 720B is connected to the fluid return line 722 through one or more fluid supply fittings 752 and conventional tubing 755 that is in fluid communication with the connector 730 and the return fluid line 161B of the fluid source 161.

In one embodiment, the internal regions of the gas plenums 172A, 172B of are connected to the pump 163 which is connected to the pressure ports 716, 718 that contains a connectors 734, 736 contained in the manifold 714, and a fittings 756, 758 that is disposed within the internal region 713 of the device 700. In one embodiment, the gas plenums 172A, 172B formed in the body element of the device 700 can be cyclically filled with a fluid so that a bellows-like motion and/or compression forces can be applied to portions of the extremity of a mammal in a desired time appropriate manner.

During the operation of the device 700, a hand, a forearm, a foot, a leg, an upper extremity, or a lower extremity (not shown) is disposed within the opening 712 of the device 700 and enclosed within the one or more body elements 710 with one or more gas plenums 172A, 172B and one or more thermal exchange units 720A, 720B attached thereon and the manifold 714 attached thereto. Alternatively, the device may need to be assembled by folding, rolling one or more body elements and enclosed with one or more enclosing clips. In addition, one or more detachable thermal exchange units may be pre-assembled inside the device or may be assembled upon disposing an extremity into the device. Then, a sealing portion 741 of the seal element 740 is wrapped around the opening of the device to attach the device to the extremity disposed in the internal region 713.

In one embodiment, a fluid sensing assembly 760 is disposed within the fluid supply line 161A to sense the temperature of the fluid entering the one or more thermal exchange units 720A, 720B so that heating or cooling elements contained within fluid source 161 can be controlled by the controller 160. The fluid sensing assembly 760 generally contains a body 762 and one or more sensors 761 that are in thermal communication with the fluid being delivered to the one or more thermal exchange units 720A, 720B. The one or more sensors 761 may be a thermistor, RTD, thermocouple, or other similar device that can be used to sense the temperature of the fluid flowing through the body 762 and the fluid supply line 161A. It is generally desirable to position the one or more sensors 761 as close to the one or more thermal exchange units 720A, 720B as possible, to assure that the environment will not affect the temperature control of the fluid delivered to the one or more thermal exchange units 720A, 720B.

To control the various aspects of the process of increasing the blood flow and temperature control of a mammal, the controller 160 is adapted to control all aspects of the processing sequence. In one embodiment, the controller 160 is adapted to control the fluid source 161, the pump 163, and all other required elements of the device 700 so that a controlled pressure can be delivered to the extremity by the gas plenums 172A, 172B and a controlled temperature can be supplied to the one or more thermal exchange units 720A, 720B to control the temperature of the patient. The controller 160 is generally configured to receive inputs from a user and/or various sensors (e.g., pressure sensor 162, fluid sensing assembly 760) in the device and appropriately control the components in accordance with the various inputs and software instructions retained in the controller's memory. The controller 160 generally contains memory and a CPU which are utilized by the controller to retain various programs, process the programs, and execute the programs when necessary. The memory is connected to the CPU, and may be one or more of a readily available memory, such as random access memory (RAM), read only memory (ROM), floppy disk, hard disk, or any other form of digital storage, local or remote. Software instructions and data can be coded and stored within the memory for instructing the CPU. The support circuits are also connected to the CPU for supporting the processor in a conventional manner. The support circuits may include cache, power supplies, clock circuits, input/output circuitry, subsystems, and the like all well known in the art. A program (or computer instructions) readable by the controller 160 determines which tasks are performable in the device. Preferably, the program is software readable by the controller 160 and includes instructions to monitor and control the process based on defined rules and input data.

Figure 8:
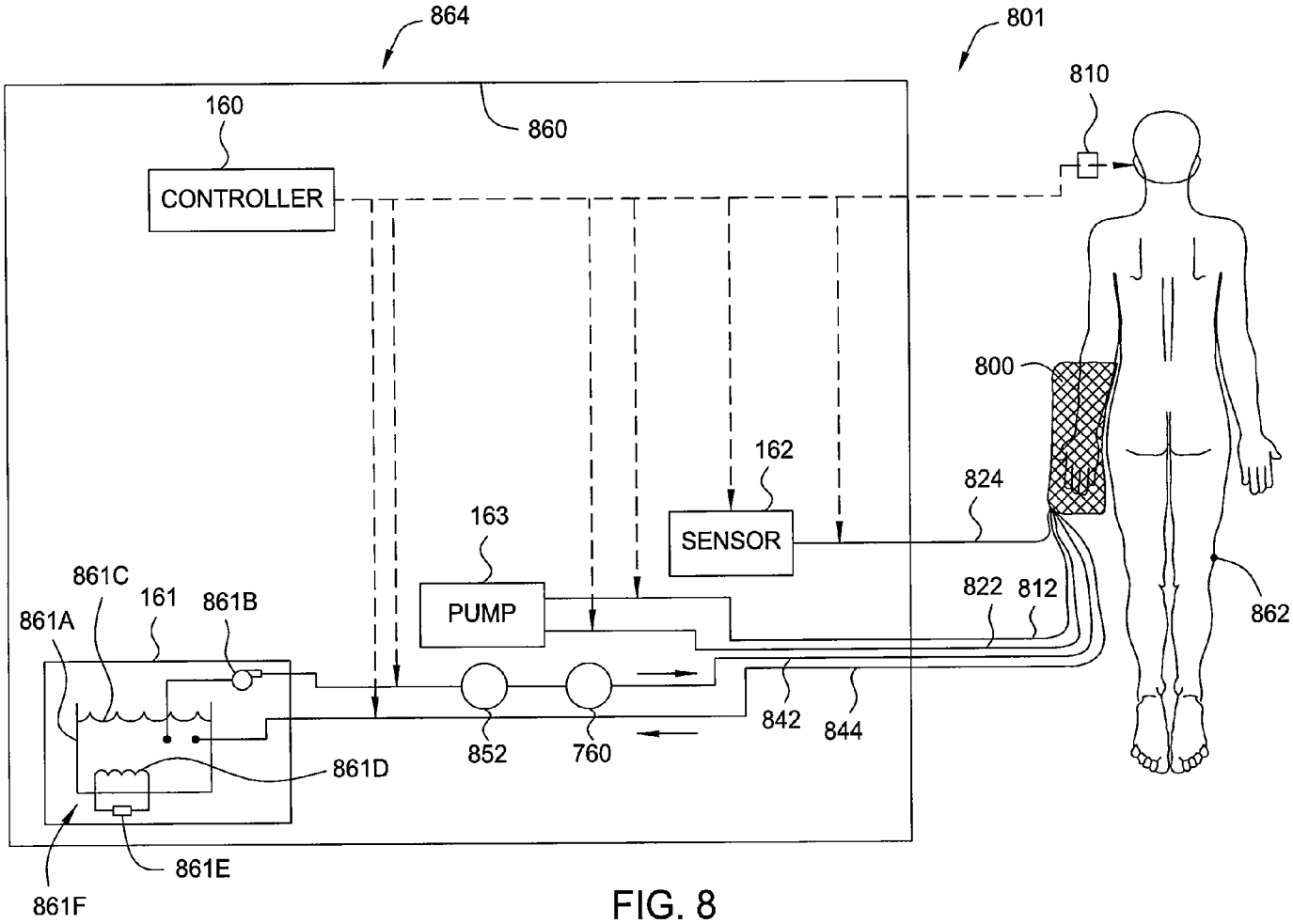
FIG. 8 illustrates one embodiment of a control unit connected to a device according to an embodiment of the invention.

FIG. 8 illustrates one embodiment of a control assembly 801 that has a control system 864 that is connected to various parts of a device 800 according to an embodiment of the invention. The device 800 and control system 864 is similar to the devices (e.g., reference numbers 100, 400-1000) and control system 164 discussed herein. The control system 864 generally contains a controller module 860 having the controller 160 therein that houses all the electronics and mechanical parts which are required to regulate the temperature, and compression pressurized force provided to the gas plenums found in the device 800. In this configuration, the control system 864 typically includes, for example, a pump 163, a pressure sensor 162, conventional tubing 824, a fluid source 161, a fluid flow sensor 852, a fluid sensing assembly 760, and a temperature sensor 810. The temperature sensor 810 is generally a device that is used to measure the temperature of the patient while the process of increasing the blood flow and controlling the temperature of the patient is being performed. Temperature of the patient can be measured in the ear, mouth, on the skin, or rectally using an appropriate conventional temperature sensing device. The control system 864 may also contain a thermal exchange medium pump, a heater, a cooler, thermocouples, a heating medium pump, a proportional-integral-derivative (PID) controller for process control of the vacuum and the temperature, one or more power supplies, display panels, actuators, connectors, among others, that are controlled by the controller 160. The settings and current readings of the various elements in the of the control system 864 may be conveniently positioned onto a display panel (e.g., lighted display, CRT) which provides an operator interface. In alternative embodiments, the pressure control and temperature control may be controlled by two different controllers.

The control system 864 may provide safety features including a device shutdown feature that is activated if the device sensors, such as the temperature and pressure sensors, fail or become disconnected. The control system 864 may also include an alarm circuit or an alert signal if the temperature of the apparatus is not regulated correctly. A relief valve may be provided within the pressure loop of the device such that the gas plenums may be vented if the pressure within the gas plenums exceeds a certain level.

In one embodiment, a temperature probe 862 can be provided to measure the temperature of a portion of a mammal other than a foot, leg, or other extremity where the device is attached to. In another embodiment, a tympanic membrane can be attached to the ear canal as a temperature sensor 810 to provide core temperature reading. As such, a reference temperature for the human, such as a patient, can be obtained. Other sensors may include patient's blood flow and blood pressure and heart rate. These data are important to proper patient health care keeping the patient at normal temperature range and from various thermal maladies. The temperature of the skin in the device could be measured to indicate if the body portion is in a state of vasoconstriction or vasodilatation or what temperature the skin is compared two device fluid temperatures. Temperature of the skin can be measured by different means and different devices like Thermocouples, Thermistor, Heat flux and other measuring devices. Blood flow rate could also be measured and data sent to the controller 160.

As shown in FIG. 8, the device 800 can be connected to the pump 163 (e.g., mechanical pump) via a port 812 and a pressure sensor return line 822 to provide a pressure to the gas plenums inside the device 800. It is important to maintain the pressure levels and correctly sense and read out the pressure levels inside the gas plenums. The pressure transducer could also be located in the manifold 714 (FIG. 7) allowing for a better response and more accurate control of the vacuum levels. The signal controlling the pump would come through wires from the pressure transducer to control circuits in the controller 160. Additional set of data, such as pressure data applied to the extremity by the pump, could be measured through a series of pressure sensors placed within the device to record pressure levels and send data to the controller 160 for evaluation. The controller 160 can then adjust the levels of pressure and the temperature within the device to produce the highest level of blood flow and to increase the body's core temperature as needed.

In addition, the device 800 with one or more thermal exchange units (e.g., reference numerals 120A, 120B in FIG. 1) therein may be connected to the fluid source 161 via a thermal exchange medium supply line 842 and a thermal exchange medium return line 844. Further, the flow of a thermal exchange medium flowing inside the thermal exchange medium supply line 842 can be monitored and regulated by the fluid flow sensor 852 and/or fluid sensing assembly 760. In one embodiment, the fluid source 161 contains a fluid tank 861A in which the thermal exchanging medium 861C resides, a mechanical pump 861B that is used to deliver the thermal exchanging medium 861C to the one or more thermal exchange units (not shown) contained in the device 800, and a heater assembly 861F. The heater assembly 861F may contain a heating element 861D and a heater controller 861E that are used to control the temperature of the heating elements 861D and the thermal exchanging medium 861C. In addition, a low fluid LED may be used and displayed on the front panel of the controller 160 to warn an operator of fluid level in the reservoir of a fluid source. Additional sensor will be added to the fluid reservoir to send a signal when the fluid level is low and more fluid is needed. Further, there may be controlling signal that allow a conventional fluid pump to operate in a mode of returning fluid back from the fluid pads when the procedure or a single operation of the device is complete. Additionally, the device may include a temperature sensor for the heated or cooled fluid circulating through various tubing's and fluid lines. In addition, the thermal exchange units of the invention may include one or more temperature sensors and thermocouples to monitor the temperature of a mammal's extremity and provide temperature control feedback.

These lines and ports of the invention may be bundled, contained, and strain-relieved in the same or different protective sheaths connected to the controller 160. The lines may also be contained in the same or different tubing set with different enclosures for each medium used, such as fluid, pressure, electric heat, and air lines.

In one embodiment, the thermal exchange units are coupled in a closed loop configuration with the fluid source 161 which provides a thermal exchange medium. For example, the thermal exchange unit may be coupled in a closed liquid loop configuration with a liquid tank contained in the fluid source 161 housed within the controller module 860. In one embodiment, one or more resistive heating elements (e.g., reference numeral 861D) and/or thermoelectric devices contained in the fluid source 161 are used to heat or cool the thermal exchange medium 861C contained in the tank 861A. The closed loop configuration reduces the maintenance requirements for the operator because it minimizes the loss of thermal exchange medium that typically occurs if the thermal exchange unit is detached from the thermal exchange medium source. Contamination of the thermal exchange medium source is also minimized by the closed loop configuration. Contamination of the thermal exchange medium such as water can also be reduced by adding an antimicrobial agent to the thermal exchange medium source. In different embodiments, the thermal exchange medium may be either a liquid or a gas. In practice, the thermal exchange medium flow rate should be as high as possible. It was found through testing that the inflow temperature and the outflow temperature through the pad should be within about <1.0° C. It has also been found that, in certain cases, blood flow did not increase at all if the pad fluid temperature was below 40° C. A high flow rate allows better temperature consistency, results in less thermal loss, and creates better thermal exchange. In a closed loop configuration including the thermal exchange unit and the thermal exchange medium source, with a total system volume (e.g., 0.75 liters), a flow rate (e.g., 2 liters per minute) transfers as much fluid through the thermal exchange unit (e.g., twice than a flow rate of 0.35 liters per minute).

In one embodiment, the heating elements 861D and the heater controller 861E contained within fluid source 161 are adapted to prevent damage to the various components in the system and/or injury to the patient. In this case, the heating element 861D that is used to exchange heat with thermal exchange medium 861C has one or more voltage or current limiting devices connected thereto to prevent a dangerous condition from occurring during the use of the control assembly 801. In one embodiment, the heating element 861D contains a material that has a positive temperature coefficient that causes the resistance of the heating element 861D to decrease as the temperature of the heating elements 861D increases. Therefore, by careful selection of the power delivery elements in the heater controller 861E and the heating elements 861D the system can be designed to prevent unwanted damage to the device or dangerous conditions from occurring, while being able to achieve a desired heating element temperature. The dangerous conditions are avoided by the limitation in maximum temperature that can be achieved by the heating elements 861D due to the limit in power (e.g., current×resistance) generated by the heating elements 861D by limiting the voltage or current supplied by the heater controller 861E.

In an alternative embodiment, the thermal exchange unit and pressure delivery lines may be connected to the controller 160 using actuated fittings such as quick connect fittings with an automatic shut off mechanism. The automatic shut off mechanism halts the pressure application and the heating medium flow as soon as the pressure delivery lines are disconnected. Actuated fittings may also allow the operator to change thermal exchange units. In addition, various quick disconnect connectors may be added to the controller 160 to allow various disposable parts of the device to be disconnected after each use. It is generally desirable to allow one or more portions of the device 800 to be separated from the one or more of the control system 864 components when needed to allow the patient freedom to be moved and positioned during the temperature control process and/or other procedures, such as surgical procedures, performed on the patient. As noted above, one benefit of one or more of the embodiments described herein over the prior art is the ability to use at least a portion of a single extremity to regulate the temperature of the core of a patient.

The embodiments of the apparatus described above provide a method of increasing blood flow in one or more extremities of a mammal and decreasing clots within the veins in order to regulate thermal maladies and/or prevent deep vein thrombosis (DVT). The method includes providing one or more devices of the invention to the mammal and regulating the temperature of the one or more extremities of the mammal using the devices. As a result, one or more Arteriovenous Anastomoses (AVAs) blood vessels inside an extremity of a mammal are vasodilator, and constriction of the AVA blood vessels is reduced, thereby increasing blood flow and blood volume in the one or more extremities, decreasing the vessel wall contact time of the blood flow, and decreasing clots in the veins due to pooling. Any suitable portions of an extremity, preferably an extremity with vasculature that can be vasodilator by the device, may be placed into a device and sealed therein. The efficient control of a patient's core temperature can be improved by exchanging heat with extremities that contain a high concentration of AVAs (e.g., hands, feet, arms).

Referring to FIG. 1, the process of using the device 100 discussed above generally starts by positioning an extremity 130 in the space 150 of the device 100. While the process of increasing blood flow and the temperature of a mammal is discussed in conjunction with the device 100, this configuration is not intended to be limiting to the scope of the invention since any of the devices discussed herein could be used to perform this process. Once the extremity 130 is enclosed in the device 100, pressure is applied to a fluid supply port 176 thereby increasing the pressure within the one or more gas plenums and exposing the extremity 130 to an contact pressure supplied by the one or more gas plenums. The applied pressure may in the range, for example, of about 0 to about 25 mmHg, such as from about 10 mmHg to about 14 mmHg. Simultaneously or sequentially, a temperature controlled thermal exchange medium is introduced into one or more thermal exchange units 120A, 120B positioned inside the space 150 of device 100. The flow rate of the fluid delivered from the fluid source 161 may be constant and the flow rate need only be to maintain so that a desired temperature can be achieved in the thermal exchanging units 120A, 120B.

In one embodiment, the controller 160 manages the thermal exchange medium and the pressure in the gas plenums for the duration of the treatment, which may be about 30 minutes, for example. The duration may be longer or shorter depending on the size of the extremity treated and the temperature of the extremity. The process may be repeated one or more times as needed. In some cases, the duration of the treatment may be cycled "on" for a period of time and then "off" for a time period. In one example, the duration of the treatment is about 1 minute or longer and then off for a period of about 1 minute or longer, which is repeated for 5 cycles or more. The controller is configured to halt the treatment after each treatment period. A "stop" button on the control unit may be used to turn off both the thermal exchange medium supply and the pressure supplied to the gas plenums. In one aspect, the controller 160 is designed to monitor the expansion of the lower limb to determine venous refilling so that the refill time can be adjusted as desired. In general, only small amounts of pressure are needed to be supplied to the extremity to cause movement of blood within the extremity, such as between 0 mmHg and about 25 mmHg. In one embodiment, a pressure between about 10 mmHg and about 15 mmHg is applied to the extremity to cause movement of blood. In one example, the one or more thermal exchange units 120A, 120B are brought into contact with the extremity by applying a positive pressure of about 3 mmHg to the extremity to provide good contact between the thermal exchange units, and then the pressure in the internal region is increased to about 20 mmHg for 30-60 seconds to increase the pressure on the extremity and cause the blood to be pumped. The pressure applied to the extremity can then be cyclically varied between a lower pressure and a higher pressure level for a desired number of times. When the cycled pressure drops to a low pressure (e.g., 0-3 mmHg) level this provide time for venous refilling. In one embodiment, it is desirable to measure the venous refill time (VRT) of the extremity of the patient, and/or control the delivery of pressure to the extremity to assure that the limb has completely refilled before the next pressure cycle is performed. In one embodiment, the controller 160 is adapted to receive input from the user, or from one or more sensors, regarding the VRT of the patient's extremity so that the controller 160 can control and optimally manage pressure cycles, temperature of the thermal exchange units, and/or the duration of the treatment.

Embodiments of the invention may be used to increase blood flow and regulate the temperature of a mammal by increasing the temperature of the thermal exchange medium delivered to the thermal exchange devices to a temperature as high as possible without burning the mammal. In a healthy patient, burning of the cells on the appendage can occur if the cell temperature exceeds about 43 degrees Celsius (° C.), but this may vary with exposure time and rate of thermal transfer. Therefore, the temperature of the thermal exchange medium is preferably calibrated such that skin temperature is maintained at less than 43 degrees Celsius. For example, different people have different tolerance levels for different temperature ranges, according to their ages, health conditions, etc. In general, to heat the extremity it is desirable to control the temperature of the thermal exchange medium and thus the surface of the thermal exchange units to a temperature is between about 30° C. to about 43° C. In one embodiment, the temperature of the thermal exchange medium and thus the surface of the thermal exchange units is between about 37° C. to about 40° C.

In addition, the device can be used to cool the temperature of a patient. In general, a patient's temperature can be maintained, or, if it is required by the procedure, the patient's core temperature can be lowered by active cooling to about 33° C. In general, to cool the extremity it is desirable to control the temperature of the thermal exchange medium and thus the surface of the thermal exchange units to a temperature is between about 0° C. to about 30° C. In one embodiment, the temperature of the thermal exchange medium and thus the surface of the thermal exchange units are between about 0° C. to about 10° C.

Consequently, in order to reduce patient discomfort, the controller may be configured with different temperature and vacuum settings. In one embodiment, one treatment setting is "High", which includes the highest temperature and highest pressure setting. "Medium" and "Low" settings have progressively lower settings for temperature and/or pressure. Patients who are being treated for an extended amount of time or who are at high risk for additional complications may be treated on the "Low" setting. For example, extra care is provided for applying pressure and thermal regulation to patients who are under anesthesia. In one embodiment, the high temperature is about 42° C., the medium temperature is about 41° C., and the low temperature is 40° C., while the vacuum level remains at about 10 mmHg for all temperature settings.

In a further aspect, the device may use between about 5 watts and about 250 watts of power to raise a body core temperature at a rate of between about 4° C./hour and about 12° C./hour. Preferably, the power applied is between about 5 watts and about 80 watts, although a power of up to about 250 watts may be used. In contrast, conventional convective warming blankets that heats the whole body may use about 500 watts, which is harder to control and is less efficient.

Table 1 illustrates exemplary suitable applied power (in watts) as compared to contact surface area. In one embodiment, the surface of contact between the thermal exchanging units (e.g., reference numerals 120A, 120B, 220, 320A, 320B) and the skin of the extremity is between about 30 $in^2$ (e.g., 0.019 $m^2$) and about 410 $in^2$ (e.g., 0.264 $m^2$). In another embodiment, the surface of contact between the thermal exchanging units and the skin of the extremity is less than about 800 $in^2$ (e.g., 0.516 $m^2$). In general, it is desirable to maximize the contact between the thermal exchanging units and the skin of the extremity to improve heat transfer. However, it is through the use of the AVAs that are primarily found in the extremities that provide the most efficient and controlled heat transfer between the extremity and the thermal exchanging units.

TABLE 1

| | 1 | 2 | 3 | 4 | 5 | 6 | 7 | 8 |
|---|---|---|---|---|---|---|---|---|
| % Area | 1.25% | 2.5% | 4.86% | 3.62% | 8.28% | 16.56% | 10.25% | 13.48% |
| Area $in^2$ | 37.5 | 75.0 | 145.8 | 108.6 | 248.4 | 496.8 | 307.5 | 404.4 |
| Watt/$in^2$ | 0.32 | 0.32 | 0.24 | 0.32 | 0.24 | 0.24 | 0.16 | 0.16 |
| Watts | 12.0 | 24.0 | 35.0 | 34.8 | 59.6 | 119.2 | 49.2 | 64.7 |
| Watts to Core | 6.0 | 12.0 | 17.5 | 17.4 | 29.8 | 59.6 | 6.2 | 32.4 |

The testing as described herein was done in lab using a device similar to the one shown in FIG. 1. The percentage (%) increase per minute in the local blood volume of the extremity was measure. Volunteer human subjects were participated in the study. The "% Area" row illustrates the percentage of area of the patients body covered by the thermal exchanging units (e.g., reference numeral 120A, 120B in FIG. 1) used to perform the process. The "Area sq. inch" row illustrates the actual square inches covered by the thermal exchanging units. The "Watt/sq. inch", "Watts", and "Watt to Core" are examples of the power and power densities used in exemplary versions of the devices discussed herein. The columns labeled "1"-"8" illustrate different thermal exchanging unit and device configurations.

Figure 9:
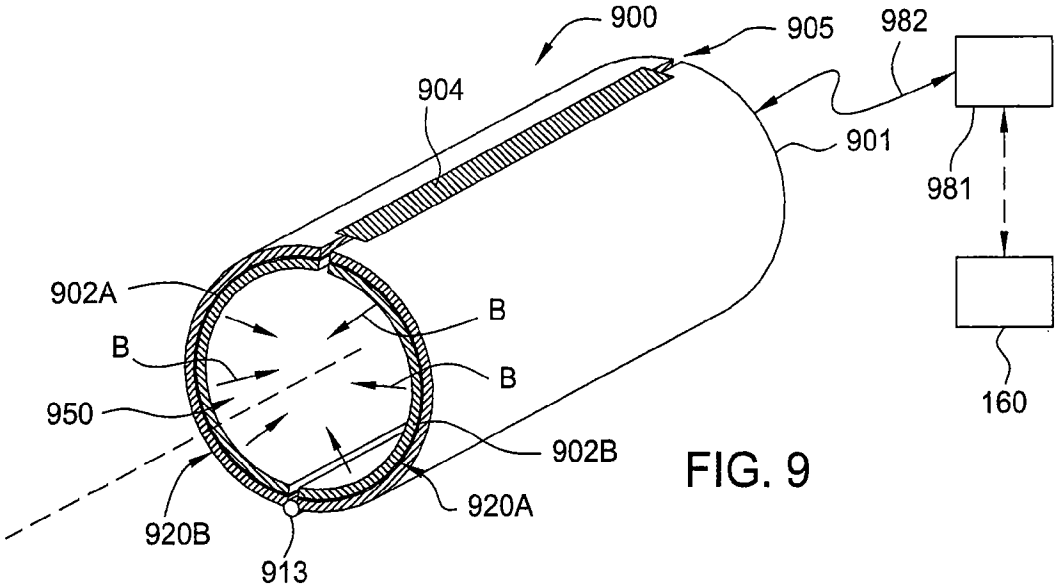
FIG. 9 is a isometric view of an exemplary device according to one embodiment of the invention.

In one embodiment, as shown in FIG. 9, a device 900 is used to apply pressure to an extremity of a mammal this disposed within the space 950 formed within the fluid plenum 901 by use of a fluid source 981 that is in communication with the controller 160. In use the fluid source 981 is adapted to provide and recirculate a heat exchanging fluid through compliant fluid plenums 902A, 902B to thermally regulate the temperature and apply a pressure to the extremity of the patient disposed in the space 950. The use of one or more compliant fluid plenums 902A, 902B to provide pressure to the extremity 130 and regulate the temperature of the extremity can reduce the system cost and complexity. In this configuration, the fluid source 981 is generally adapted to provide fluid through the compliant fluid plenums 902A, 902B at a desired temperature and a desired pressure to create an efficient heat transfer between the extremity and the compliant fluid plenums 902A, 902B. Each compliant fluid plenum may include one or more internal regions (i.e., internal sealed region within the unit) that are connected to a fluid tubing 982 and fluid source 981 so that the internal regions can be filled with fluids when the extremity 130 is positioned inside the device 900.

The fluid plenum 901 generally contains compliant fluid plenums 902A, 902B, a support feature 920A, 920B and a sealing element 904. In one embodiment, as shown in FIG. 9, the support feature 920A, 920B of the fluid plenum 901 are formed in two parts that are hingedly joined at one end (i.e., hinge 913) and connected at the other end (i.e., gap 905) by use of a sealing element 904 (e.g., zipper, Velcro fasteners). In one embodiment, the compliant fluid plenums 902A, 902B are formed from the same materials that are discussed above in conjunction with the thermal exchanging units discussed above (e.g., reference numerals 120A and 120B). In one embodiment, support feature 920A, 920B are formed from a hard plastic, metal, composite or other structurally desirable material so that they are strong enough to receive the pressure load (e.g., reference numeral "B") supplied by the compliant fluid plenums 902A, 902B against the patient's extremity. In one embodiment, it is desirable to thermally insulate the exterior surfaces of the support feature 920A, 920B to reduce the thermal losses to the environment.

Figure 10:
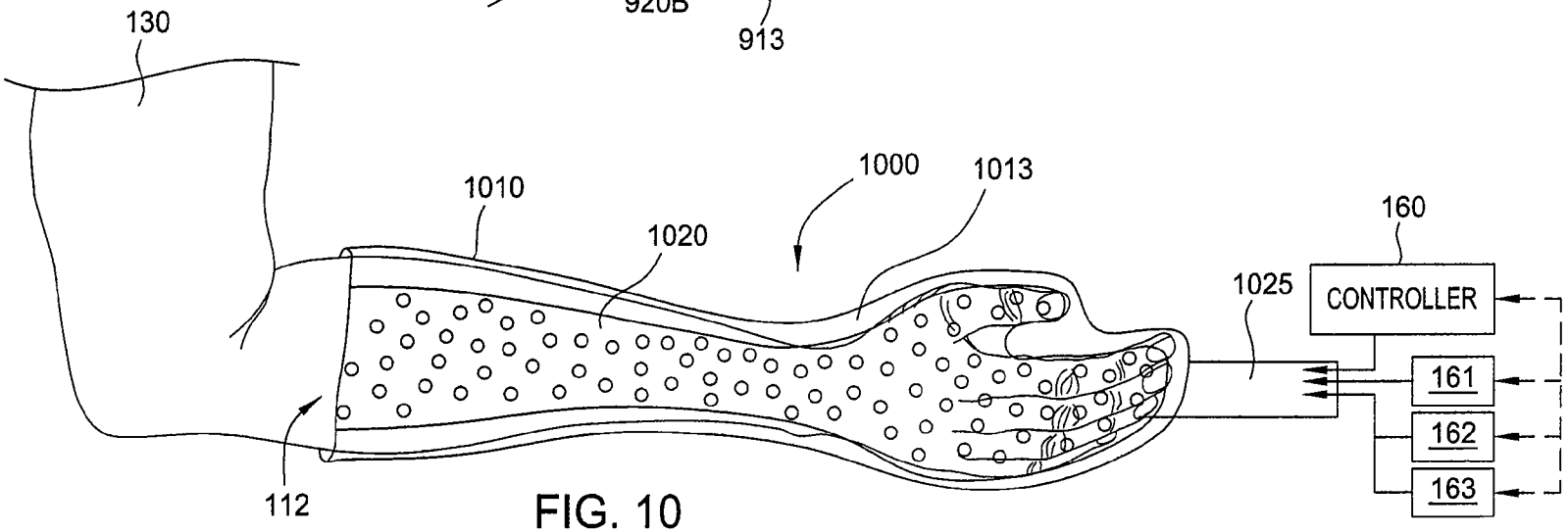
FIG. 10 is a side view of an exemplary device according to one embodiment of the invention.

FIG. 10 is a side view that illustrates an example of a device 1000 that is used to control the temperature of an extremity 130 that is disposed and sealed therein according to one or more embodiments of the invention. The extremity 130 enclosed within the device 1000 can, for example, be a hand and forearm as shown in FIG. 10, but this configuration is not intended to limiting as to the scope of the invention. In this configuration, the one or more thermal exchange units 1020 are sized to heat the desired area of the extremity 130 that is positioned within an internal region 1013 of the body element 1010. The temperature of the thermal exchange units 1020 can be regulated by use of the controller 160 and fluid source 161, which is schematically illustrated in FIG. 10. The pressure applied to the extremity can regulated by use of the controller 160, a pump 163 and sensor 162 that are connected to a gas plenum (not shown), or the pressure delivered from the fluid source 161 can be controlled so that a desirable amount of pressure can be delivered to the patient's extremity by controlling the fluid pressure of the temperature regulated fluid delivered to the one or more thermal exchange units 1020. While only a single thermal exchange unit 1020 is shown in FIG. 10, this configuration is not intended to be limiting to the scope of the invention, and thus two or more thermal exchange units 1020 may be positioned around various parts of the extremity 130 to improve perfusion. Referring to FIG. 10, a generalized port 1025 can be used to bundle up various fluid ports and pressure ports together and connected to the controller 160, the fluid source 161, pressure sensor 162 an/or a pump 163.

Figure 11:
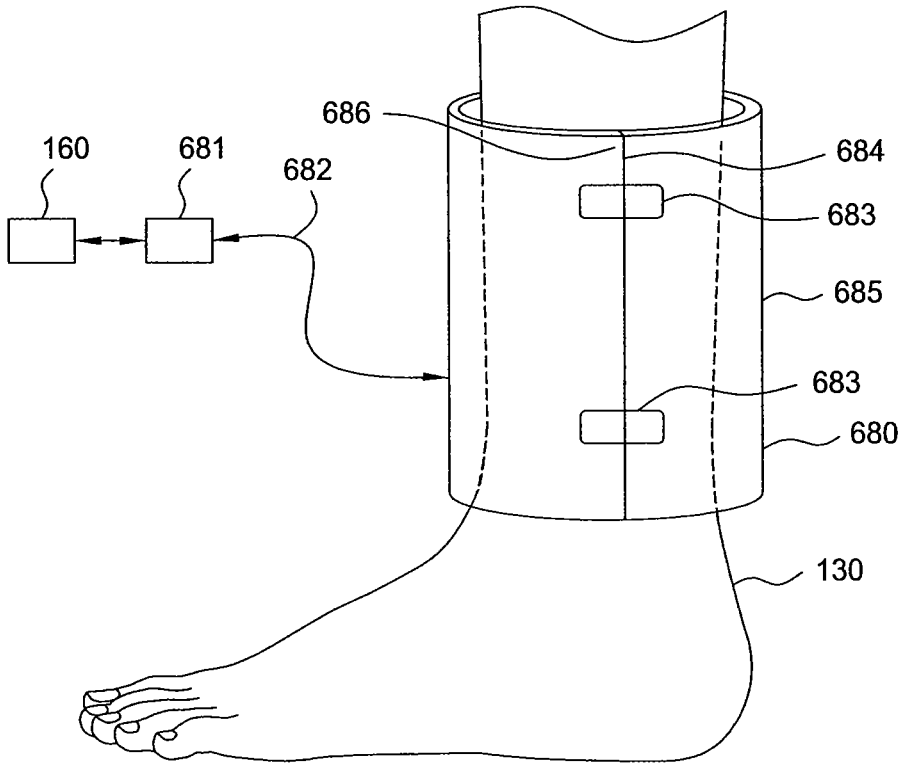
FIG. 11 is a side view of an exemplary device according to one embodiment of the invention.

In one embodiment, as shown in FIG. 11, a device 680 is used to apply pressure to an extremity 130 of a mammal. In this configuration, a fluid source 681 is adapted to provide and recirculate a heat exchanging fluid through a compliant fluid plenum 685 to thermally regulate the temperature and apply a pressure to the extremity of the patient. The use of a single compliant fluid plenum 685 to provide pressure to the extremity 130 and regulate the temperature can reduce the system cost and complexity. In this configuration, the fluid source 681 is generally adapted to provide fluid to the compliant fluid plenum 685 at a desired temperature and a desired pressure to create an efficient heat transfer between the extremity and the compliant fluid plenum 685. Each compliant fluid plenum 685 may include one or more internal regions (i.e., internal sealed region within the unit) that are connected to a fluid tubing 682 and fluid source 681 so that the internal regions can be filled with fluids when the extremity 130 is positioned inside the device 680. While FIG. 11 illustrates the use of the device 680 on a lower extremity this configuration is not intended to be limiting as to the scope of the invention disclosed herein.

In one embodiment, the compliant fluid plenum 685 is flexible enough and sized so that it can be wrapped around a portion of the extremity 130, as shown in FIG. 11. The ends 684, 686 of the compliant fluid plenum 685 can be joined using one or more sealing elements 683, which are sized to retain the ends 684, 686 of the compliant fluid plenum 685 when pressure is applied to the extremity 130 by the fluid delivered from the fluid source 681. In another embodiment, the one or more sealing elements 683 are Velcro fasteners, straps, or other similar devices.

In one embodiment, the compliant fluid plenum 685 is formed from a pliant material, including but not limited to, urethane, polyurethane, polypropylenes, polystyrenes, high density polyethylene's (HDPE), low density polyethylene's (LDPE), poly(vinyl chloride), rubbers, elastomers, polymeric materials, composite materials, among others. In one embodiment, the compliant fluid plenum 685 is formed and assembled using two or more sheets of a compliant material that are RF welded, bonded or thermal sealed together. In another embodiment, the compliant fluid plenum 685 may be formed and assembled through injection molding. There are many possible ways to design and manufacture the compliant fluid plenum 685 to provide a flexible thermal exchange unit that does not leak.

In one embodiment, it is desirable to regulate the amount of pressure and the time interval that pressure is applied. In this embodiment, the pressure within the internal region of the compliant fluid plenum 685 can controlled using a fluid delivered from the fluid source 681 to provide a bellow-like motion to apply various different compression pressures to portions of the extremity 130 intermittently, consecutively, or otherwise in a time appropriate manner. A cyclic process of varying the pressure from a higher level to a lower level may be repeated one or more times as needed. In some cases, the duration of the treatment may be cycled to a higher pressure for a period of time and then to a baseline pressure for a time period. In one example, the duration of the treatment is about 10 seconds or longer at a higher pressure and then between about 60 seconds to about 120 seconds at a baseline pressure, which is repeated for 5 cycles or more. In one embodiment, the duration of the high pressure treatment is between about 10 seconds and about 5 minutes and the duration of the base line pressure treatment is between about 60 seconds and about 2 minutes. In one embodiment, the high pressure range is between about 20 mmHg and about 60 mmHg, and the baseline pressure is between about 0 mmHg and about 15 mmHg. It is believed that applying pneumatic compressions or force to portions of the extremity 130 may increase blood flow within the extremity, prevent clotting and blood pooling in the veins, and prevent deep vein thrombosis. The order of application of a baseline pressure and then a higher pressure discussed herein is not intended to be limiting as to the scope the invention described herein. In one embodiment, the difference between the applied base line pressure and the applied high pressure may vary between about 0 mmHg and about 120 mmHg. In another embodiment, the difference between the applied base line pressure and the applied high pressure may vary between about 0.1 mmHg and about 60 mmHg. In one embodiment, the difference between the applied base line pressure and the applied high pressure is between about 0 mmHg and about 45 mmHg The inflatable cuff assembly design found in device 680 can be used in conjunction with the other components discussed herein to transfer heat to the extremity and also actively pump blood within the extremity by the use of sequential compression forces applied to the extremity by the compliant fluid plenum 685 and the fluid source 681 that are in communication with the controller 160.

Figure 12A:
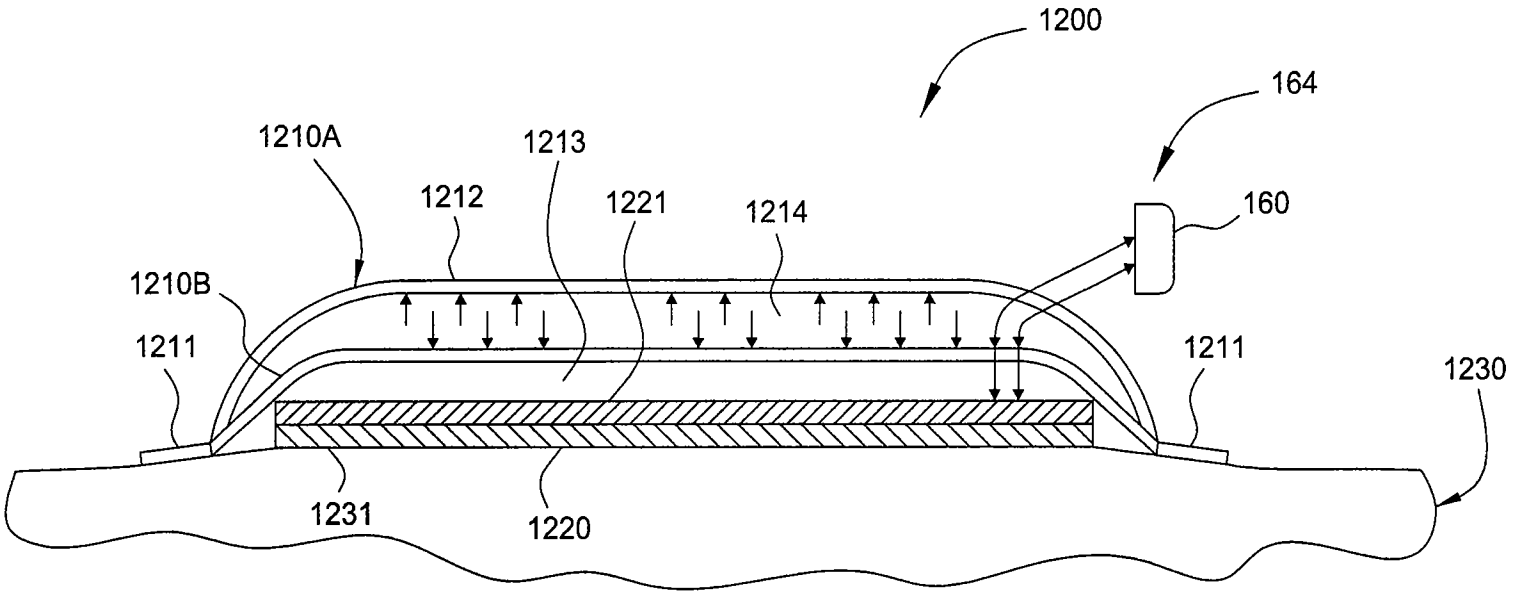
FIG. 12A is a side view of an exemplary device according to one embodiment of the invention.
Figure 12B:
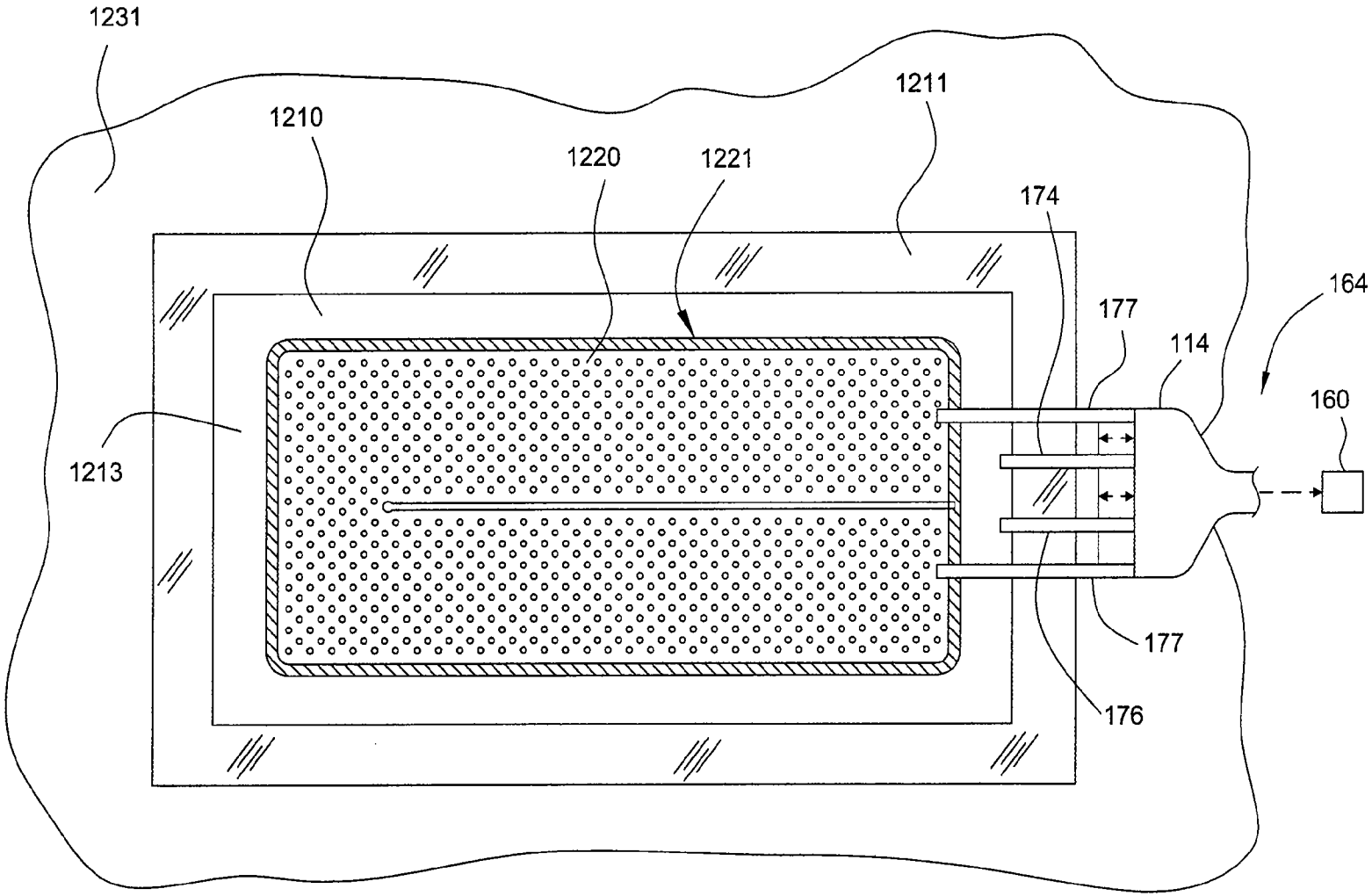
FIG. 12B is a plan view of an exemplary device illustrated in FIG. 12A according to one embodiment of the invention.

FIGS. 12A-12B illustrates an embodiment of the invention in which a device 1200 can be positioned over a desired portion of skin 1231 of a mammal 1230 to increase the blood flow and control the temperature of the mammal 1230. FIG. 12A is a cross-sectional side view of the device 1200 that has been applied to the skin 1231 of a mammal 1230. FIG. 12B illustrates a plan view of the device 1200 that has been applied to the skin 1231 of the mammal 1230. The device 1200 generally contains body element 1210 and one or more thermal exchange units 1220. The body element 1210 generally contains a sealing element 1211 and one or more compliant elements 1212. One embodiment of the body element 1210 in the device 1200, as shown in FIG. 12A, contains a pressure region 1214 that is positioned between a first body element 1210A and a second body element 1210B in which a fluid is delivered to achieve a positive pressure therein to cause the second body element 1210B to push against the one or more thermal exchange units 1220 and skin 1231. The pressure delivered in the pressure region 1214 can be any desirable pressure, such as between about 0.1 mmHg to about 80 mmHg above atmospheric pressure. In one embodiment, the pressure delivered in the pressure region 1214 is between about 0.1 mmHg to about 15 mmHg above atmospheric pressure. In this way the device 1200 can be positioned on any open area of the patient, such as positions on a human's back, chest, thigh, or neck to the blood flow and control the temperature of the subject by application of pressure to the pressure region 1214 and thermal control of the one or more thermal exchange units 1220.

In general, the body element 1210 components can be made of a disposable low cost material, a biocompatible material, a material that can be sterilized, and/or a hypo allergic material similar to the materials discussed above in conjunction with the body element 110. The compliant elements 1212 is generally formed from a collapsible and pliant material, including but not limited to, urethane, polyurethane, polypropylenes, polystyrenes, high density polyethylene's (HDPE), low density polyethylene's (LDPE), poly(vinyl chloride), rubbers, elastomers, polymeric materials, composite materials, among others. The compliant elements 1212 can be made of a transparent or semi-transparent material that allows viewing of the skin 1231 region of the mammal 1230. The thickness of the compliant element 1212 is not limited as long as it can sustain the pressurized conditions when the device 1200 is used. In one example, a thickness from about 1.5 mils to about 12 mils can be used to pliantly conform to the shape and size of the portion of the skin 1231 contained therein.

The sealing element 1211 is generally used to form a seal to the skin 1231 of the mammal 1230 so as to enclose the one or more thermal exchange units 1220 in an internal region 1213. The sealing element 1211 is generally designed to form a seal between the body element 1210 and the skin to allow a pressurized condition to be applied within the formed pressure region 1214 by use of the control system 164 and the other supporting equipment discussed above (e.g., reference numerals 160-163). The sealing element 1211 can be made of a sticky seal material, such as hydrogel, polyurethane, urethane, among others. Another example is a PS series thermoplastic polyurethane from Deerfield Urethane, Inc. Disposable sealing materials may be manufactured and packaged such that they are sterile before use and/or hypoallergenic to meet health and safety requirements. The sealing element 1211 may include an air permeable portion and/or made of a permeable membrane material or a breathable material to permit the flow of air.

The one or more thermal exchange units 1220 are generally similar to the devices discussed above in conjunction with FIGS. 3A-3B. In one embodiment, as shown in FIG. 12A, the one or more thermal exchange units 1220 have an insulating layer 1221 disposed on one or more sides of the device to reduce heat loss to environment away from the skin 1231 and/or improve the heat transfer process to the skin 1231.

Referring to FIG. 12B, during operation the control system 164 components are used to create a pressurized condition in the pressurized region 1214 by use of the various fluid ports or pressure ports, such as the fluid supply ports 174, 176 that pass through one or more apertures formed in the body element 1210. In one embodiment, the one or more thermal exchange units 1220 are in communication with the system controller 164 components via the fluid supply line ports 177.

In one embodiment, an internal region 1213 (FIG. 12A) formed in the device 1200 is evacuated by use of a vacuum pump (not shown) that is connected to the pressure port 1216 to create a vacuum condition in the internal region 1213. The sub-atmospheric pressure created in the internal region 1213 will cause the atmospheric pressure external to the device 1200 to urge the compliant element(s) 1212 against the one or more thermal exchange units 1220 and/or skin 1231 to increase the blood flow and control the temperature of the mammal 1230. In one embodiment, the internal region 1213 may also be open to the atmosphere to prevent gas pressure building up in this region when second body element 1210B is being urged against the patient's skin when pressurized region 1214 is under pressure. In this way the device 1200 can be positioned on any open area of the subject, such as positions on a mammal's back, chest, thigh, or neck to increase the blood flow and control the temperature of the subject.

In one aspect of the invention, the device used to control the core temperature of the patient is designed to reduce or minimize the spread of infection. In one embodiment, the components that come into contact with the patient or other sources of germs are used once and then thrown away to prevent the spread of infection between multiple patients. For example, referring to FIG. 1, the one or more body elements 110, the one or more thermal exchange units 120A, 120B, and the manifold 114 are discarded after each use.

One or more embodiments of the invention described herein, may also prevent or minimize the chance of infection commonly found in prior art devices that require the movement of air across the skin of patient to transfer heat to the patient. The movement of air in the prior art devices can cause the movement of unwanted materials that can cause infection. In one embodiment, at least a portion of the patient is partially enclosed by one or more elements of the device (e.g., body element 110 in FIG. 1) and thus will not cause, and also tend to prevent, the movement of air borne contaminants that can cause infection in the patient or other exposed personnel.

While the foregoing is directed to embodiments of the present invention, other and further embodiments of the invention may be devised without departing from the basic scope thereof, and the scope thereof is determined by the claims that follow.

What is claimed is:

1. A device for controlling body temperature of a patient, comprising:

a plenum having one or more walls that define an internal pressure region, wherein at least one of the one or more walls form an enclosed region that is on a side of the at least one wall that is opposite to a side on which the internal pressure region is disposed, and the enclosed region is adapted to receive a portion of a patient;

one or more thermal exchanging units that are disposed between the one or more walls and the portion of the patient;

a first device that is adapted to create a pressure above atmospheric pressure within the internal pressure region of the plenum to urge the one or more thermal exchanging units against a surface of the portion of the patient;

a vacuum pump that is coupled to the enclosed region of the plenum and is adapted to create a pressure below atmospheric pressure within the enclosed region; and the device for controlling body temperature further comprising a third device that is in fluid communication with an internal region of an inflatable cuff which is positioned over a portion of the extremity, wherein the third device is adapted to adjust the pressure in the internal region of the inflatable cuff.

* * * * *